US011160145B2

(12) United States Patent
Lester et al.

(10) Patent No.: US 11,160,145 B2
(45) Date of Patent: Oct. 26, 2021

(54) DRAWER APPARATUS FOR RADIO FREQUENCY HEATING AND DEFROSTING

(71) Applicant: NXP USA, Inc., Austin, TX (US)

(72) Inventors: David Paul Lester, Phoenix, AZ (US); Daniel Joseph Viza, Phoenix, AZ (US)

(73) Assignee: NXP USA, Inc., Austin, TX (US)

( * ) Notice: Subject to any disclaimer, the term of this patent is extended or adjusted under 35 U.S.C. 154(b) by 442 days.

(21) Appl. No.: 15/721,256

(22) Filed: Sep. 29, 2017

(65) Prior Publication Data

US 2019/0104575 A1 Apr. 4, 2019

(51) Int. Cl.

| | |
|---|---|
| ***H05B 6/68*** | (2006.01) |
| ***H05B 6/64*** | (2006.01) |
| ***H05B 6/54*** | (2006.01) |
| ***H05B 6/62*** | (2006.01) |

(52) U.S. Cl.

CPC ..... *H05B 6/688* (2013.01); *H05B 6/54* (2013.01); *H05B 6/62* (2013.01); *H05B 6/647* (2013.01); *H05B 6/6408* (2013.01)

(58) Field of Classification Search

CPC ..... H05B 6/12; H05B 6/1254; H05B 6/447; H05B 6/701; H05B 6/54; H05B 6/62; H05B 6/6408; H05B 6/647; H05B 6/688; H05B 6/1245–1254; H05B 6/6447; A47J 39/02

USPC ..... 219/703

See application file for complete search history.

(56) References Cited

U.S. PATENT DOCUMENTS

| | | | | |
|---|---|---|---|---|
| 2,633,400 | A * | 3/1953 | Ring | F24C 15/16 312/410 |
| 3,271,169 | A | 9/1966 | Baker et al. | |
| 3,302,632 | A | 2/1967 | Fichtner | |
| 3,797,870 | A * | 3/1974 | Beckman | E05C 3/14 70/84 |
| 4,303,820 | A | 12/1981 | Stottmann et al. | |
| 4,333,521 | A | 6/1982 | Stottman et al. | |
| 4,812,609 | A * | 3/1989 | Butot | H05B 6/54 219/771 |

(Continued)

FOREIGN PATENT DOCUMENTS

| | | | |
|---|---|---|---|
| CN | 108812854 | A | 11/2017 |
| CN | 108521691 | A | 9/2018 |

(Continued)

OTHER PUBLICATIONS

U.S. Appl. No. 16/221,315; not yet published; 49 pages, filed Dec. 14, 2018.

(Continued)

*Primary Examiner* — Ibrahime A Abraham
*Assistant Examiner* — Spencer H. Kirkwood

(57) ABSTRACT

A radio-frequency (RF) heating system may include a removable drawer, which may be inserted under a fixed shelf of the RF heating system to form an enclosed cavity. The drawer may include conductive channels or side rails that may interface with the shelf of the defrosting system in order to electrically couple the drawer to the RF heating system. The drawer may include an electrode that is electrically coupled to ground or to a RF signal source when the drawer is inserted beneath the shelf. The shelf may include selectable electrodes of varying sizes. The RF heating system may use identification circuitry to recognize the type of drawer that has been inserted beneath the shelf. RF energy may be applied to the electrode of the drawer or the shelf to heat a load in the enclosed cavity.

8 Claims, 16 Drawing Sheets

(56) References Cited

U.S. PATENT DOCUMENTS

| | | | | |
|---|---|---|---|---|
| 4,978,826 | A | 12/1990 | DeRuiter et al. | |
| 4,980,530 | A | 12/1990 | Butot | |
| 5,266,766 | A * | 11/1993 | Hecox | H05B 6/54 219/388 |
| 5,541,392 | A * | 7/1996 | Miklos | H05B 6/62 219/771 |
| 5,556,567 | A * | 9/1996 | Landwehr | H05B 6/50 219/771 |
| 6,278,093 | B1 * | 8/2001 | Iacovacci | A23B 4/01 219/601 |
| 6,486,455 | B1 | 11/2002 | Merabet | |
| 6,784,405 | B2 | 8/2004 | Flugstad et al. | |
| 8,207,479 | B2 | 6/2012 | Ben-Shmuel et al. | |
| 8,637,797 | B2 * | 1/2014 | Imura | A47J 36/321 219/627 |
| 9,215,756 | B2 | 12/2015 | Bilchinsky et al. | |
| 9,265,097 | B2 | 2/2016 | Torres et al. | |
| 9,318,818 | B2 * | 4/2016 | Nakamura | H01R 13/111 |
| 2003/0068414 | A1 | 4/2003 | Ito | |
| 2006/0081624 | A1 | 4/2006 | Takada et al. | |
| 2011/0016887 | A1 | 1/2011 | Lee et al. | |
| 2012/0122072 | A1 | 5/2012 | Bilchinsky et al. | |
| 2015/0295552 | A1 | 10/2015 | Abou-Chahine et al. | |
| 2015/0351164 | A1 | 12/2015 | Wesson et al. | |
| 2017/0181455 | A1 | 6/2017 | Bullo et al. | |
| 2018/0042074 | A1 | 2/2018 | Qiu et al. | |
| 2020/0120959 | A1 | 4/2020 | Wu et al. | |

FOREIGN PATENT DOCUMENTS

| | | | |
|---|---|---|---|
| CN | 109259045 | A | 1/2019 |
| GB | 621320 | A | 4/1949 |
| GB | 844154 | A | 8/1960 |
| JP | S5579970 | A | 6/1980 |
| JP | S57102169 | A | 6/1982 |
| JP | 2003-024025 | A | 1/2003 |
| JP | 2003038148 | A | 2/2003 |
| JP | 2004-247128 | A | 9/2004 |
| JP | 4311997 | B2 | 8/2009 |
| JP | 2012207900 | A | 10/2012 |
| JP | 2013111107 | A | 6/2013 |
| TW | M478803 | U | 5/2014 |

OTHER PUBLICATIONS

U.S. Appl. No. 16/594,215; not yet published; 50 pages, filed Oct. 7, 2019.

Notice of Allowance; U.S. Appl. No. 16/221,315; 9 pages, filed Apr. 9, 2021.

* cited by examiner

DRAWER APPARATUS FOR RADIO FREQUENCY HEATING AND DEFROSTING

TECHNICAL FIELD

Embodiments of the subject matter described herein relate generally to apparatus and methods of defrosting and heating a load with radio frequency (RF) energy.

BACKGROUND

Conventional capacitive food defrosting (or thawing) systems include large planar electrodes contained within a heating compartment. After a food load is placed between the electrodes and the electrodes are brought into contact with the food load, low power electromagnetic energy is supplied to the electrodes to provide gentle warming of the food load. In these conventional capacitive food defrosting systems, the electrodes on which the food load rests may require cleaning after defrosting or thawing operations take place. For example, drip and condensation from thawing foods may accumulate in the heating compartment of the system, and may putrefy or create an environment where harmful bacteria can grow if left unattended. However, it may be difficult or inconvenient to clean the electrodes or the heating compartment of conventional systems.

Additionally, conventional capacitive food defrosting systems include a heating compartment having a fixed size and shape. Defrosting a food load in a heating compartment that is significantly larger than the food load may be inefficient with respect to the amount of power used to perform the defrosting. Conversely, some food loads may be too large for a given heating compartment to accommodate.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
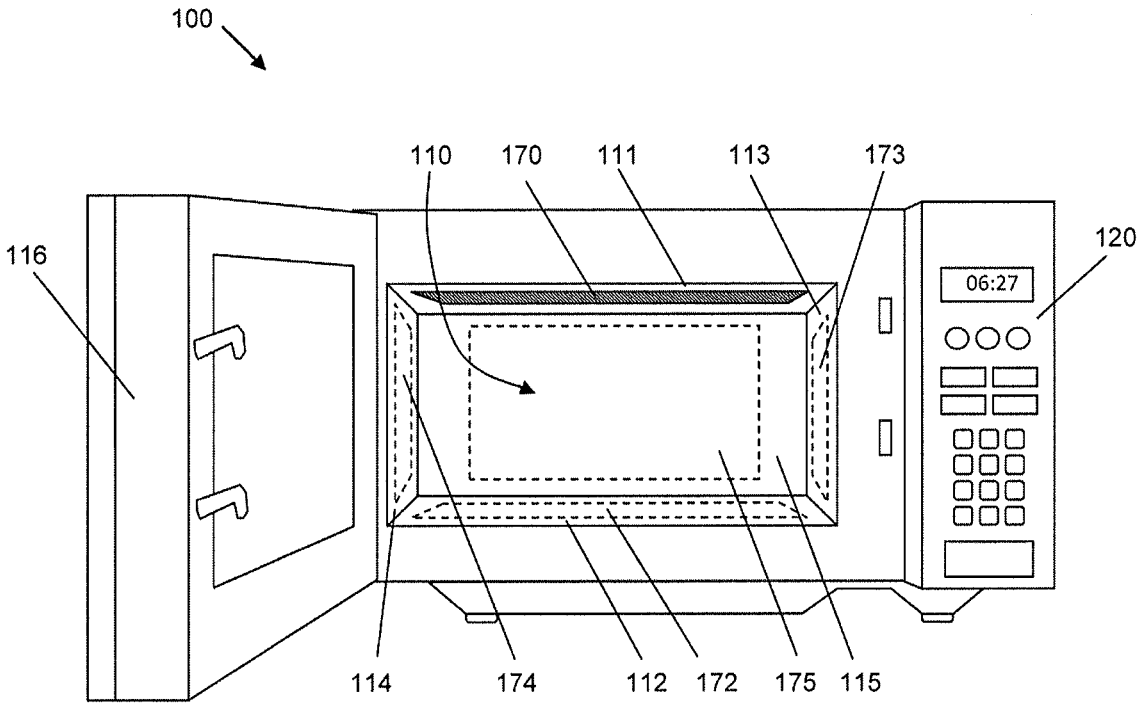
FIG. 1 is a perspective view of a defrosting appliance, in accordance with an example embodiment.

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the inventive subject matter include apparatus and methods for defrosting and/or heating food loads (or other types of loads) with heating compartments or electrodes that can be removed for cleaning and/or that have modular resonance cavities to accommodate loads of different sizes and/or shapes. Embodiments of the subject matter described herein relate to a solid-state defrosting or heating apparatus that may be incorporated into stand-alone appliances or into other systems. As described in greater detail below, exemplary defrosting/heating systems are realized using a first electrode disposed in a cavity, an amplifier arrangement (including one or more transistors), an impedance matching network coupled between an output of the amplifier arrangement and the first electrode, and a measurement and control system that can detect progress of a defrosting operation of the defrosting apparatus. In an embodiment, the impedance matching network is a variable impedance matching network that can be adjusted during the defrosting operation to improve matching between the amplifier arrangement and the cavity.

Generally, the term "defrosting" means to elevate the temperature of a frozen load (e.g., a food load or other type of load) to a temperature at which the load is no longer frozen (e.g., a temperature at or near 0 degrees Celsius). Note that in the present disclosure references to a "food load" are made as an example of a load for the defrosting system and it should be understood that references to a food load may also refer to other types of loads (e.g., liquids, non-consumable materials) that may be heated by the defrosting system.

As used herein, the term "defrosting" more broadly means a process by which the thermal energy or temperature of a load (e.g., a food load or other type of load) is increased through provision of RF power to the load. Accordingly, in various embodiments, a "defrosting operation" may be performed on a food load with any initial temperature (e.g., any initial temperature above or below 0 degrees Celsius), and the defrosting operation may be ceased at any final temperature that is higher than the initial temperature (e.g., including final temperatures that are above or below 0 degrees Celsius). That said, the "defrosting operations" and "defrosting systems" described herein alternatively may be referred to as "thermal increase operations" and "thermal increase systems." The term "defrosting" should not be construed to limit application of the invention to methods or systems that are only capable of raising the temperature of a frozen load to a temperature at or near 0 degrees Celsius.

During the defrosting of a load, liquid may accumulate in the containment structure of a defrosting system as a result of condensation or leaking. This liquid may undesirably putrefy if left unattended for too long, which can create a need for cleaning the containment structure of the defrosting system. It therefore may be advantageous for defrosting systems to include removable containment structures (e.g., drawers or platforms) for easier cleaning compared to defrosting systems without removable containment structures. For example, some defrosting systems may be disposed in locations that are difficult for a consumer to reach for the length of time associated with thorough cleaning, such as on a tall shelf or close to the ground. In contrast, removable containment structures, such as the drawers discussed herein, may be moved to a location where cleaning may be performed more easily and effectively, such as a sink.

Furthermore, conventional defrosting systems generally include electrodes and containment structures having fixed sizes and shapes. However, an electrode or a containment structure having a given size and shape may not be ideal for defrosting loads having a variety of shapes and/or sizes. For example, defrosting a load in a containment structure that is significantly larger than the load may be inefficient with respect to the amount of power used to perform the defrosting operation. Conversely, some loads may be too large for a given containment structure to accommodate. As another example, defrosting a load using comparatively larger electrodes may result in power inefficiency as a portion of the RF energy passing between the electrodes during defrosting will not go toward heating the load. Conversely, defrosting a load using comparatively smaller electrodes may result in the load not being heated evenly or completely, as portions of the load that are not overlapped by the electrodes may not receive as much RF energy as the portions of the load that are overlapped by the electrodes. It therefore may be advantageous to use a defrosting system that is compatible with multiple drawers having different shapes and sizes and/or having electrodes of different shapes, sizes, or configurations so that loads of varying shape and size may be accommodated.

FIG. 1 is a perspective view of a defrosting system 100, in accordance with an example embodiment. Defrosting system 100 includes a defrosting cavity 110, a control panel 120, one or more radio frequency (RF) signal sources (e.g., RF signal source 340, FIG. 3), a power supply (e.g., power supply 350, FIG. 3), a first electrode 170, power detection circuitry (e.g., power detection circuitry 380, FIG. 3), and a system controller (e.g., system controller 330, FIG. 3). The defrosting cavity 110 is defined by interior surfaces of top, bottom, side, and back cavity walls 111, 112, 113, 114, 115 and an interior surface of door 116. With door 116 closed, the defrosting cavity 110 defines an enclosed air cavity. As used herein, the term "air cavity" may mean an enclosed area that contains air or other gasses (e.g., defrosting cavity 110).

According to an embodiment, the first electrode 170 is arranged proximate to a cavity wall (e.g., top wall 111), the first electrode 170 is electrically isolated from the remaining cavity walls (e.g., walls 112-115 and door 116), and the remaining cavity walls are grounded. In such a configuration, the system may be simplistically modeled as a capacitor, where the first electrode 170 functions as one conductive plate, the grounded cavity walls (e.g., walls 112-115) function as a second conductive plate (or electrode), and the air cavity (including any load contained therein) function as a dielectric medium between the first and second conductive plates. Although not shown in FIG. 1, a non-electrically conductive barrier (e.g., barrier 314, FIG. 3) also may be included in the system 100, and the non-conductive barrier may function to electrically and physically isolate the load from the bottom cavity wall 112. Although FIG. 1 shows the first electrode 170 being proximate to the top wall 111, the first electrode 170 alternatively may be proximate to any of the other walls 112-115, as indicated by alternate electrodes 172-175.

According to an embodiment, during operation of the defrosting system 100, a user (not illustrated) may place one or more loads (e.g., food and/or liquids) into the defrosting cavity 110, and optionally may provide inputs via the control panel 120 that specify characteristics of the load(s). For example, the specified characteristics may include an approximate weight of the load. In addition, the specified load characteristics may indicate the material(s) from which the load is formed (e.g., meat, bread, liquid). In alternate embodiments, the load characteristics may be obtained in some other way, such as by scanning a barcode on the load packaging or receiving a radio frequency identification (RFID) signal from an RFID tag on or embedded within the load. Either way, as will be described in more detail later, information regarding such load characteristics enables the system controller (e.g., system controller 330, FIG. 3) to establish an initial state for the impedance matching network of the system at the beginning of the defrosting operation, where the initial state may be relatively close to an optimal state that enables maximum RF power transfer into the load. Alternatively, load characteristics may not be entered or received prior to commencement of a defrosting operation, and the system controller may establish a default initial state for the impedance matching network.

To begin the defrosting operation, the user may provide an input via the control panel 120. In response, the system controller causes the RF signal source(s) (e.g., RF signal source 340, FIG. 3) to supply an RF signal to the first electrode 170, which responsively radiates electromagnetic energy into the defrosting cavity 110. The electromagnetic energy increases the thermal energy of the load (i.e., the electromagnetic energy causes the load to warm up).

During the defrosting operation, the impedance of the load (and thus the total input impedance of the cavity 110 plus load) changes as the thermal energy of the load increases. The impedance changes alter the absorption of RF energy into the load, and thus alter the magnitude of reflected power. According to an embodiment, power detection circuitry (e.g., power detection circuitry 380, FIG. 3) continuously or periodically measures the forward and/or reflected power along a transmission path (e.g., transmission path 348, FIG. 3) between the RF signal source (e.g., RF signal source 340, FIG. 3) and the first electrode 170. Based on these measurements, the system controller (e.g., system controller 330, FIG. 3) may detect completion of the defrosting operation, as will be described in detail below, or determine that the food load has reached a desired temperature or end state. According to a further embodiment, the impedance matching network is variable, and based on the forward and/or reflected power measurements, the system controller may alter the state of the impedance matching network during the defrosting operation to increase the absorption of RF power by the load.

Figure 2:
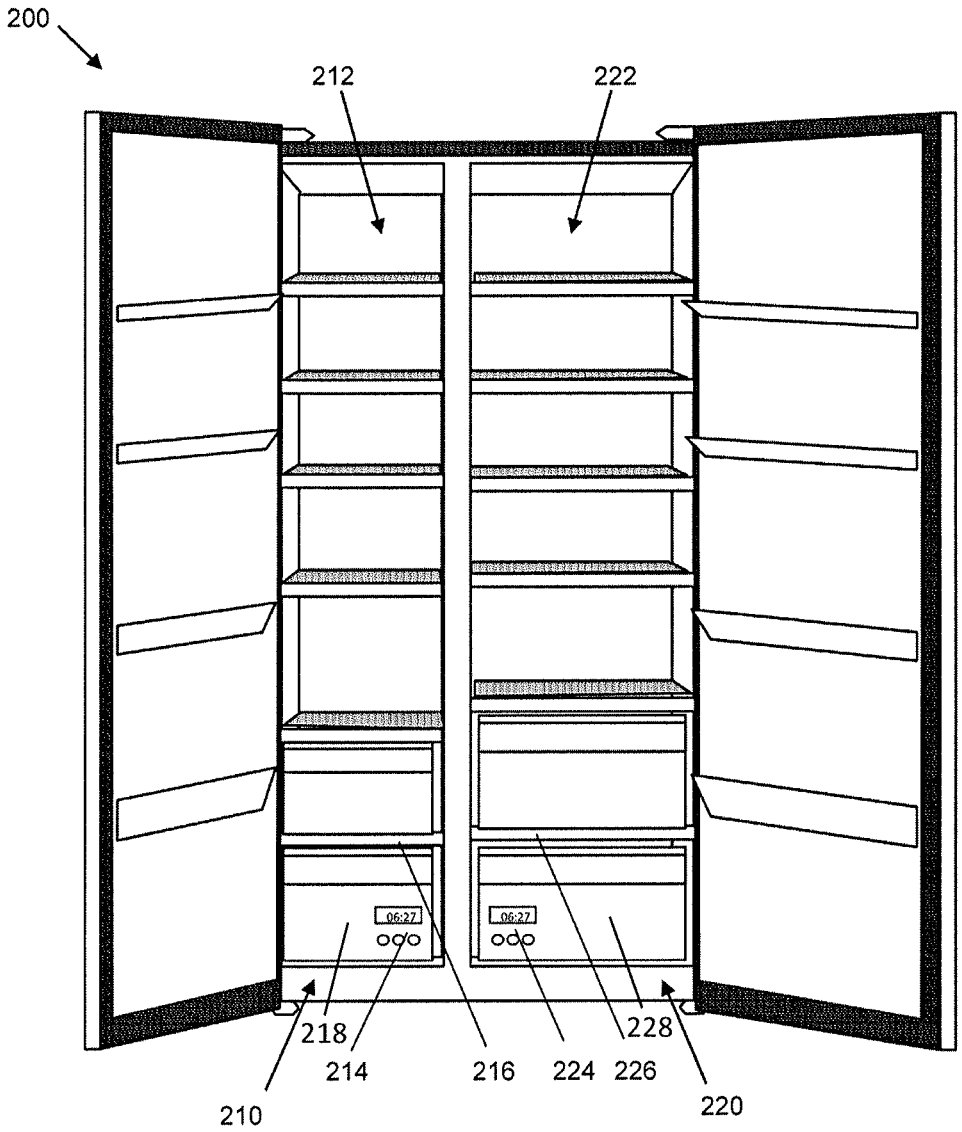
FIG. 2 is a perspective view of a refrigerator/freezer appliance that includes other example embodiments of defrosting systems.

The defrosting system 100 of FIG. 1 is embodied as a counter-top type of appliance. In a further embodiment, the defrosting system 100 also may include components and functionality for performing microwave cooking operations. Alternatively, components of a defrosting system may be incorporated into other types of systems or appliances. For example, FIG. 2 is a perspective view of a refrigerator/freezer appliance 200 that includes other example embodiments of defrosting systems 210, 220. More specifically, defrosting system 210 is shown to be incorporated within a freezer compartment 212 of the system 200, and defrosting system 220 is shown to be incorporated within a refrigerator compartment 222 of the system. An actual refrigerator/freezer appliance likely would include only one of the defrosting systems 210, 220, but both are shown in FIG. 2 to concisely convey both embodiments.

Figure 3:
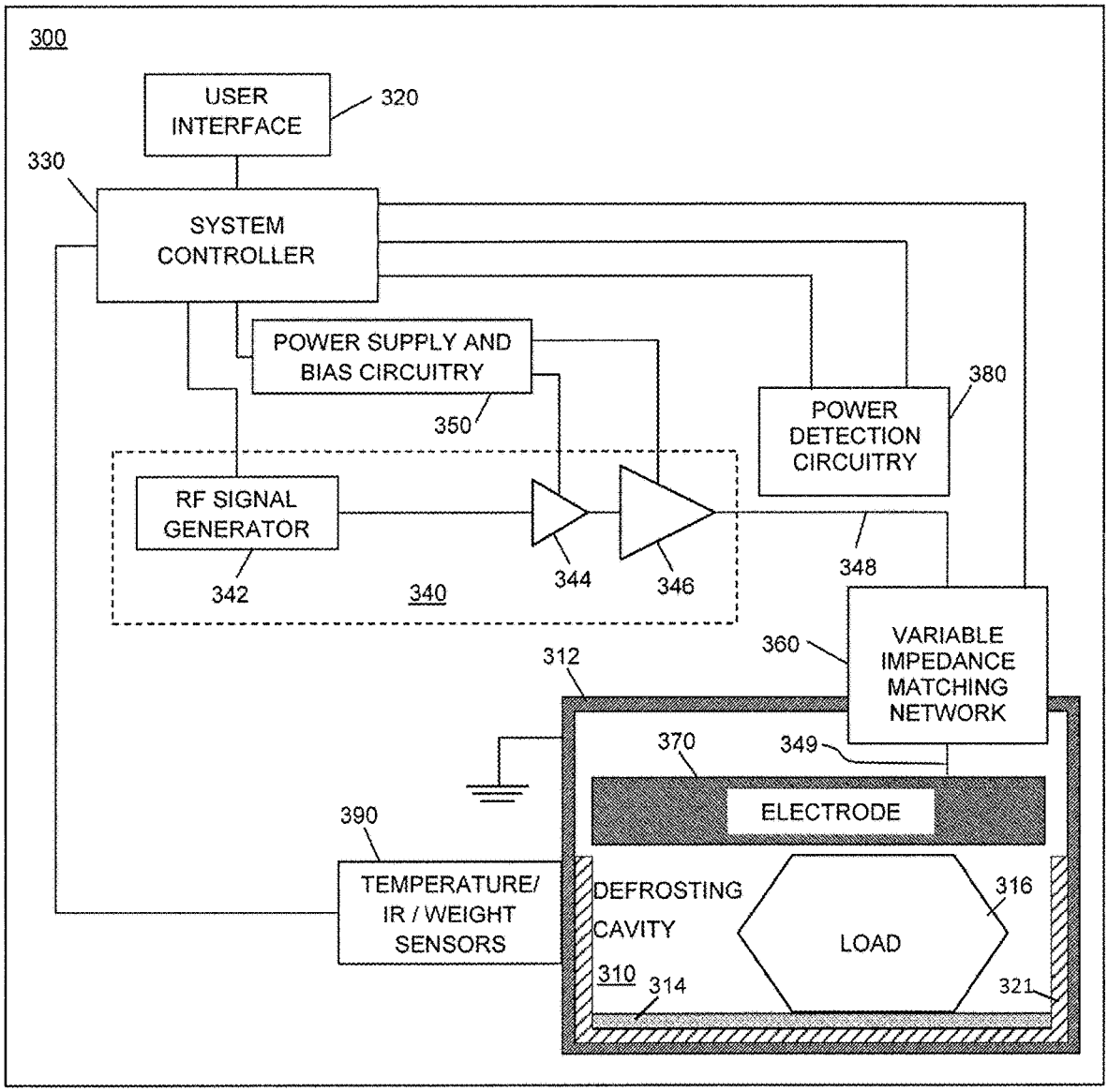
FIG. 3 is a simplified block diagram of a defrosting apparatus, in accordance with an example embodiment.

Similar to the defrosting system 100, each of defrosting systems 210, 220 includes a defrosting cavity, a control panel 214, 224, one or more RF signal sources (e.g., RF signal source 340, FIG. 3), a power supply (e.g., power supply 350, FIG. 3), a first electrode (e.g., electrode 370, 770, 1704, 1706, 1708, 1812, FIGS. 3, 7, 17, 18), a second electrode (e.g., electrode 772, 1504, 1604, FIGS. 7, 15, 16), power detection circuitry (e.g., power detection circuitry 380, FIG. 3), drawers 218, 228, and a system controller (e.g., system controller 330, FIG. 3). For example, the defrosting cavity may be defined by interior surfaces of bottom, side, front, and back walls of a drawer 218, 228 (e.g., drawer 321, 721, 1110, 1210, 1412, 1802, FIGS. 3, 7, 11, 12, 14, 18), and an interior top surface of a fixed shelf 216, 226 (e.g., shelf 1426, 1804, FIGS. 14, 18) under which the drawer 218, 228 may be slid, inserted, or otherwise physically engaged. The drawers 218, 228 may contain or may act as the second electrode for the systems 210, 220. With the drawer 218, 228 slid fully under the shelf, the drawer 218, 228 and shelf 216, 226 define the cavity as an enclosed air cavity. The components and functionalities of the defrosting systems 210, 220 may be substantially the same as the components and functionalities of defrosting system 100, in various embodiments.

In addition, according to an embodiment, each of the defrosting systems 210, 220 may have sufficient thermal communication with the freezer or refrigerator compartment 212, 222, respectively, in which the system 210, 220 is disposed. In such an embodiment, after completion of a defrosting operation, the load may be maintained at a safe temperature (i.e., a temperature at which food spoilage is retarded) until the load is removed from the system 210, 220. More specifically, upon completion of a defrosting operation by the freezer-based defrosting system 210, the cavity within which the defrosted load is contained may thermally communicate with the freezer compartment 212, and if the load is not promptly removed from the cavity, the load may re-freeze. Similarly, upon completion of a defrosting operation by the refrigerator-based defrosting system 220, the cavity within which the defrosted load is contained may thermally communicate with the refrigerator compartment 222, and if the load is not promptly removed from the cavity, the load may be maintained in a defrosted state at the temperature within the refrigerator compartment 222.

Those of skill in the art would understand, based on the description herein, that embodiments of defrosting systems may be incorporated into systems or appliances having other configurations, as well. Accordingly, the above-described implementations of defrosting systems in a stand-alone appliance, a microwave oven appliance, a freezer, and a refrigerator are not meant to limit use of the embodiments only to those types of systems.

Although defrosting systems 100, 200 are shown with their components in particular relative orientations with respect to one another, it should be understood that the various components may be oriented differently, as well. In addition, the physical configurations of the various components may be different. For example, control panels 120, 214, 224 may have more, fewer, or different user interface elements, and/or the user interface elements may be differently arranged. Further, the control panels 214, 224 may be positioned elsewhere (e.g., on a wall within the freezer or refrigerator compartment 212, 222 or on one of the fixed shelves 216, 226). In addition, although a substantially cubic defrosting cavity 110 is illustrated in FIG. 1, it should be understood that a defrosting cavity may have a different shape, in other embodiments (e.g., cylindrical, and so on). Further, defrosting systems 100, 210, 220 may include additional components (e.g., a fan, a stationary or rotating plate, a tray, an electrical cord, and so on) that are not specifically depicted in FIGS. 1, 2.

FIG. 3 is a simplified block diagram of a defrosting system 300 (e.g., defrosting system 100, 210, 220, FIGS. 1, 2), in accordance with an example embodiment. Defrosting system 300 includes defrosting cavity 310, user interface 320, system controller 330, RF signal source 340 configured to produce RF signals, power supply and bias circuitry 350, variable impedance matching network 360, electrode 370, and power detection circuitry 380, in an embodiment. In addition, in other embodiments, defrosting system 300 may include temperature sensor(s), infrared (IR) sensor(s), and/or weight sensor(s) 390, although some or all of these sensor components may be excluded. It should be understood that FIG. 3 is a simplified representation of a defrosting system 300 for purposes of explanation and ease of description, and that practical embodiments may include other devices and components to provide additional functions and features, and/or the defrosting system 300 may be part of a larger electrical system.

User interface 320 may correspond to a control panel (e.g., control panel 120, 214, 224, FIGS. 1, 2), for example, which enables a user to provide inputs to the system regarding parameters for a defrosting operation (e.g., characteristics of the load to be defrosted, and so on), start and cancel buttons, mechanical controls (e.g., a door/drawer open latch), and so on. In addition, the user interface may be configured to provide user-perceptible outputs indicating the status of a defrosting operation (e.g., a countdown timer, visible indicia indicating progress or completion of the defrosting operation, and/or audible tones indicating completion of the defrosting operation) and other information.

System controller 330 may include one or more general purpose or special purpose processors (e.g., a microprocessor, microcontroller, Application Specific Integrated Circuit (ASIC), and so on), volatile and/or non-volatile memory (e.g., Random Access Memory (RAM), Read Only Memory (ROM), flash, various registers, and so on), one or more communication busses, and other components. According to an embodiment, system controller 330 is coupled to user interface 320, RF signal source 340, variable impedance matching network 360, power detection circuitry 380, and sensors 390 (if included). System controller 330 is configured to receive signals indicating user inputs received via user interface 320, and to receive forward and/or reflected power measurements from power detection circuitry 380. Responsive to the received signals and measurements, and as will be described in more detail later, system controller 330 provides control signals to the power supply and bias circuitry 350 and to the RF signal generator 342 of the RF signal source 340. In addition, system controller 330 provides control signals to the variable impedance matching network 360, which cause the network 360 to change its state or configuration.

Figure 15:
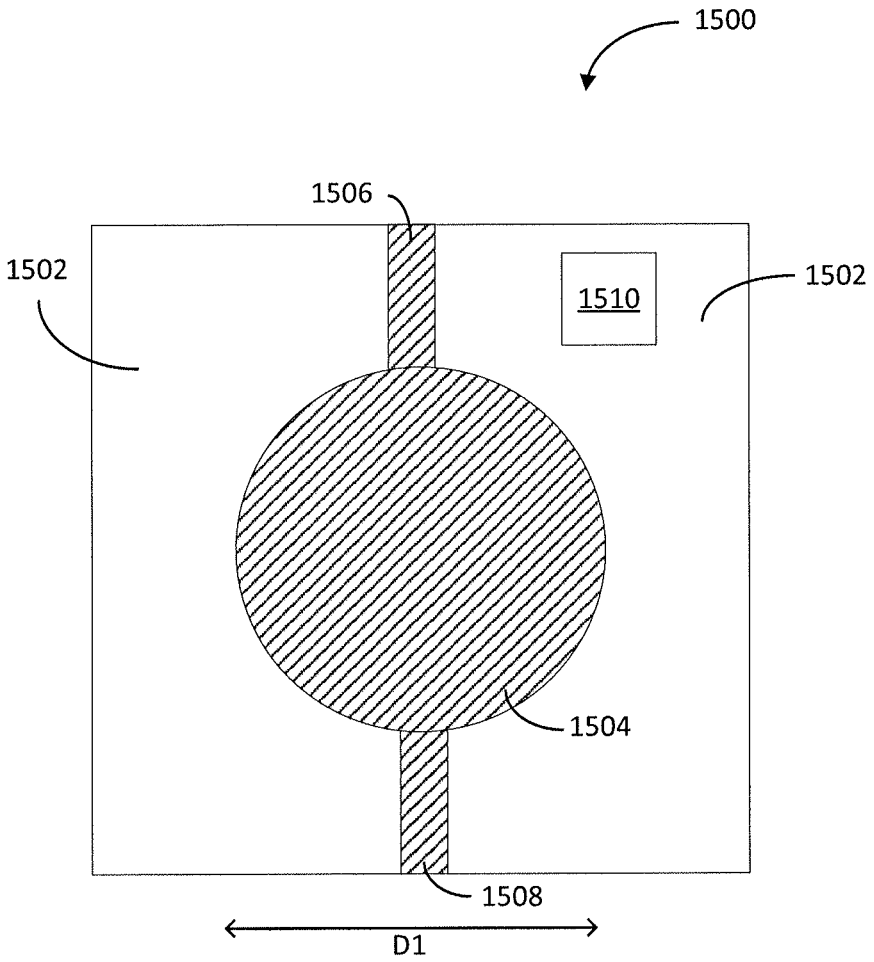
FIG. 15 is a top view of an interior bottom wall of a drawer that may be used in the drawers of FIGS. 11A-12C, where the interior bottom wall includes an electrode in accordance with an example embodiment.
Figure 16:
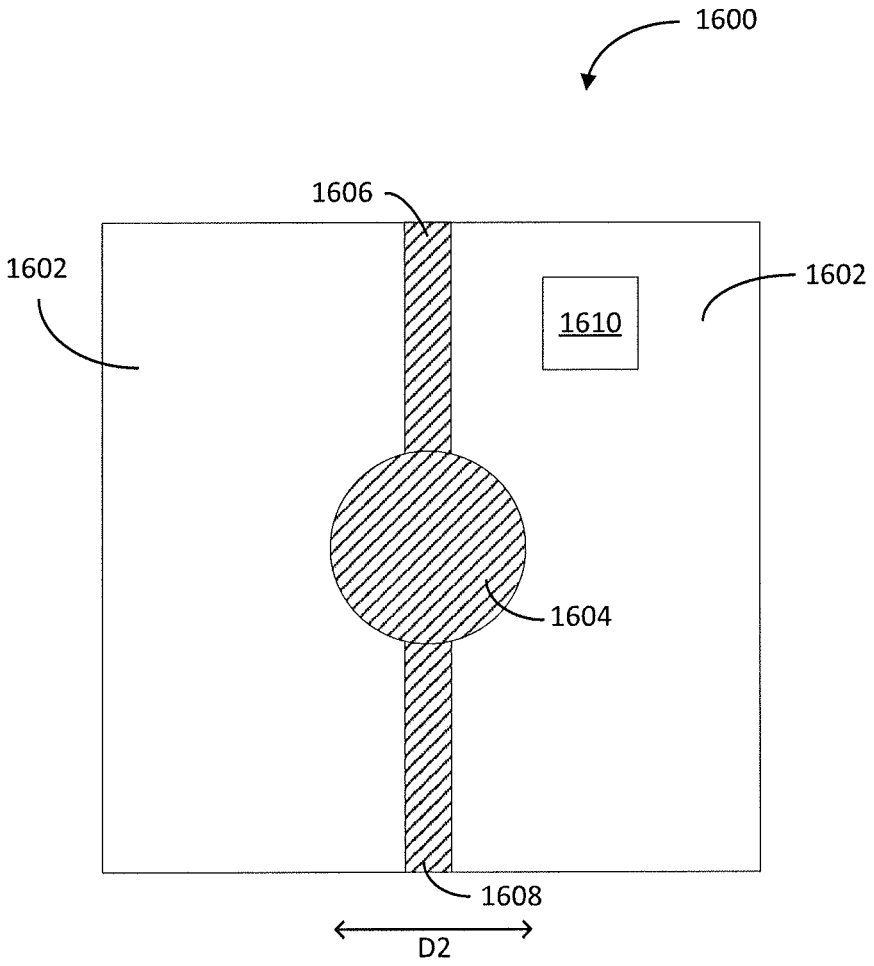
FIG. 16 is a top view of an interior bottom wall of a drawer that may be used in the drawers of FIGS. 11A-12C, where the interior bottom wall includes an electrode in accordance with an example embodiment.

Defrosting cavity 310 includes a capacitive defrosting arrangement with first and second parallel plate electrodes that are separated by an air cavity within which a load 316 to be defrosted may be placed. For example, a first electrode 370 (e.g., first electrode 770, FIG. 7 or one of electrodes 1704, 1706, 1708, 1812, FIGS. 17, 18) may be positioned above the air cavity, and a second electrode (electrode 1504, 1604, 1802, FIGS. 15, 16, 18) may be provided by a portion of a drawer 321 (e.g., drawer 218, 228, 721, 1110, 1210, 1412, 1802, FIGS. 2, 7 11, 12, 14, 18) or, for instances in which the drawer is conductive, the entirety of the drawer 321. For instances in which the drawer 321 is entirely conductive, a containment structure 312 may include bottom and side walls of the drawer 321 and the first electrode 370. In this example, the interior surfaces of the bottom and side walls of the drawer 321 in combination with the interior surface of the first electrode 370 define the cavity 310 (e.g., cavity 110, FIG. 1). According to an embodiment, the cavity 310 may be sealed (e.g., by closing a door 116, FIG. 1 or a conductive sliding door, or by sliding the drawer 321 closed under a shelf such as shelf 216, 226, 1426, 1804, FIGS. 2, 14, 18) to contain the electromagnetic energy that is introduced into the cavity 310 during a defrosting operation. For instances in which the drawer 321 is only partially conductive (e.g., as shown in FIGS. 15, 16), the containment structure 312 may include top, bottom, and side walls (e.g., completely conductive or partially conductive walls) that are not a part of the drawer 321 and that are used to contain electromagnetic energy that is introduced, for example, in the cavity 310 or elsewhere in the area surrounded by the containment structure 312 (e.g., inductors such as inductors 712-715, FIG. 7). The system 300 may include one or more interlock mechanisms that ensure that the seal is intact during a defrosting operation. If one or more of the interlock mechanisms indicates that the seal is breached, the system controller 330 may cease the defrosting operation. According to an embodiment, the containment structure 312 is at least partially formed from conductive material, and the conductive portion(s) of the containment structure may be grounded. Alternatively, at least the portion of the containment structure 312 that corresponds to the bottom surface of the cavity 310 may be formed from conductive material and grounded. Either way, the containment structure 312 (or at least the portion of the containment structure 312 that is parallel with the first electrode 370, such as a bottom interior surface or "platform" of one of drawers 218, 228, 1110, 1210, 1412, 1802, FIGS. 2, 11, 12, 14, 18) functions as a second electrode of the capacitive defrosting arrangement. To avoid direct contact between the load 316 and the grounded bottom surface of the cavity 310, a non-conductive barrier 314 may be positioned over the bottom surface (e.g., bottom wall or "platform" 1111, 1211, FIGS. 11, 12) of the cavity 310.

Defrosting cavity 310 and any load 316 (e.g., food, liquids, and so on) positioned in the defrosting cavity 310 present a cumulative load for the electromagnetic energy (or RF power) that is radiated into the cavity 310 by the first electrode 370. More specifically, the cavity 310 and the load 316 present an impedance to the system, referred to herein as a "cavity input impedance." The cavity input impedance changes during a defrosting operation as the temperature of the load 316 increases. The impedance of many types of food loads changes with respect to temperature in a somewhat predictable manner as the food load transitions from a frozen state to a defrosted state. According to an embodiment, based on reflected and/or forward power measurements from the power detection circuitry 380, the system controller 330 is configured to identify a point in time during a defrosting operation when the rate of change of cavity input impedance indicates that the load 316 is approaching a particular temperature (e.g., between −4 and 0 degrees Celsius), at which time the system controller 330 may terminate the defrosting operation. Specifically, the system controller 330 is configured to monitor reflected and/or forward power measurements over time while the food load is being defrosted. Upon detecting when the rate change in the return losses has plateaued, the controller uses historical measurement of the rates of change in return losses to determine an additional amount of time and/or energy for the defrosting process to continue in order that the food load reaches a desired end state—i.e., a tempered state between −4 and 0 degrees Celsius. Using either the determined additional amount of time or energy required, the defrosting processes can then be controlled and stopped when the food load has reached the desired end state.

The first electrode 370 is electrically coupled to the RF signal source 340 through a variable impedance matching network 360 and a transmission path 348, in an embodiment. As will be described in more detail later, the variable impedance matching circuit 360 may be disposed within a sealed portion of the cavity created by containment structure 312 (e.g., above first electrode 370), and is configured to perform an impedance transformation from an impedance of the RF signal source 340 to an input impedance of defrosting cavity 340 as modified by the load 316. In an embodiment, the variable impedance matching network 360 includes a network of passive components (e.g., inductors, capacitors, resistors). According to a more specific embodiment, the variable impedance matching network 360 includes a plurality of fixed-value inductors (e.g., inductors 412-414, 712-714, 812-814, FIGS. 4, 7, 8) that are positioned within the containment structure 312 and which are electrically coupled to the first electrode 370. In addition, the variable impedance matching network 360 includes a plurality of variable inductance networks (e.g., networks 410, 411, 500, FIGS. 4, 5), which may be located inside or outside of the cavity 310. The inductance value provided by each of the variable inductance networks is established using control signals from the system controller 330, as will be described in more detail later. In any event, by changing the state of the variable impedance matching network 360 over the course of a defrosting operation to dynamically match the ever-changing cavity input impedance, the amount of RF power that is absorbed by the load 316 may be maintained at a high level despite variations in the load impedance during the defrosting operation.

According to an embodiment, RF signal source 350 includes an RF signal generator 342 and a power amplifier (e.g., including one or more power amplifier stages 344, 346), which may be, for example, disposed behind a rear wall of a refrigerator (e.g., system 200 of FIG. 2) or may be integrated as part of a shelf assembly (e.g., shelf 216, 226, 1426, 1804, FIGS. 2, 14, 18) that forms part of containment structure 312. In response to control signals provided by system controller 330, RF signal generator 342 is configured to produce an oscillating electrical signal having a frequency in the ISM (industrial, scientific, and medical) band, although the system could be modified to support operations in other frequency bands, as well. The RF signal generator 342 may be controlled to produce oscillating signals of different power levels and/or different frequencies, in various embodiments. For example, the RF signal generator 342 may produce a signal that oscillates in a range of about 3.0 megahertz (MHz) to about 300 MHz. Some desirable frequencies may be, for example, 13.56 MHz (+/−5 percent), 27.125 MHz (+/−5 percent), and 40.68 MHz (+/−5 percent). In one particular embodiment, for example, the RF signal generator 342 may produce a signal that oscillates in a range of about 40.66 MHz to about 40.70 MHz and at a power level in a range of about 10 decibels (dB) to about 15 dB. Alternatively, the frequency of oscillation and/or the power level may be lower or higher than the above-given ranges or values.

In the embodiment of FIG. 3, the power amplifier includes a driver amplifier stage 344 and a final amplifier stage 346. The power amplifier is configured to receive the oscillating signal from the RF signal generator 342, and to amplify the signal to produce a significantly higher-power signal at an output of the power amplifier. For example, the output signal may have a power level in a range of about 100 watts to about 400 watts or more. The gain applied by the power amplifier may be controlled using gate bias voltages and/or drain supply voltages provided by the power supply and bias circuitry 350 to each amplifier stage 344, 346. More specifically, power supply and bias circuitry 350 provides bias and supply voltages to each RF amplifier stage 344, 346 in accordance with control signals received from system controller 330.

In an embodiment, each amplifier stage 344, 346 is implemented as a power transistor, such as a field effect transistor (FET), having an input terminal (e.g., a gate or control terminal) and two current carrying terminals (e.g., source and drain terminals). Impedance matching circuits (not illustrated) may be coupled to the input (e.g., gate) of the driver amplifier stage 344, between the driver and final amplifier stages 346, and/or to the output (e.g., drain terminal) of the final amplifier stage 346, in various embodiments. In an embodiment, each transistor of the amplifier stages 344, 346 includes a laterally diffused metal oxide semiconductor FET (LDMOSFET) transistor. However, it should be noted that the transistors are not intended to be limited to any particular semiconductor technology, and in other embodiments, each transistor may be realized as a high electron mobility transistor (HFET) (e.g., a gallium nitride (GaN) transistor), another type of MOSFET transistor, a bipolar junction transistor (BJT), or a transistor utilizing another semiconductor technology.

In FIG. 3, the power amplifier arrangement is depicted to include two amplifier stages 344, 346 coupled in a particular manner to other circuit components. In other embodiments, the power amplifier arrangement may include other amplifier topologies and/or the amplifier arrangement may include only one amplifier stage, or more than two amplifier stages. For example, the power amplifier arrangement may include various embodiments of a single ended amplifier, a double ended amplifier, a push-pull amplifier, a Doherty amplifier, a Switch Mode Power Amplifier (SMPA), or another type of amplifier.

Power detection circuitry 380 is coupled along the transmission path 348 between the output of the RF signal source 340 and the input to the variable impedance matching network 360, in an embodiment. In an alternate embodiment, power detection circuitry 380 may be coupled to the transmission path 349 between the output of the variable impedance matching network 360 and the first electrode 370. Either way, power detection circuitry 380 is configured to monitor, measure, or otherwise detect the power of the forward signals (i.e., from RF signal source 340 toward first electrode 370) and/or the reflected signals (i.e., from first electrode 370 toward RF signal source 340) traveling along the transmission path 348.

Power detection circuitry 380 supplies signals conveying the magnitudes of the forward and/or reflected signal power to system controller 330. System controller 330, in turn, may calculate a ratio of reflected signal power to forward signal power, or the S11 parameter. Alternatively, the system controller 330 may simply calculate the magnitude of reflected signal power. As will be described in more detail below, when the reflected to forward power ratio or the reflected power magnitude exceeds a threshold, this indicates that the system 300 is not adequately matched, and that energy absorption by the load 316 may be sub-optimal. In such a situation, system controller 330 orchestrates a process of altering the state of the variable impedance matching network until the reflected to forward power ratio or the reflected power magnitude decreases to a desired level, thus re-establishing an acceptable match and facilitating more optimal energy absorption by the load 316.

As mentioned above, some embodiments of defrosting system 300 may include temperature sensor(s), IR sensor(s), and/or weight sensor(s) 390. The temperature sensor(s) and/or IR sensor(s) may be positioned in locations that enable the temperature of the load 316 to be sensed during the defrosting operation. When provided to the system controller 330, the temperature information enables the system controller 330 to alter the power of the RF signal supplied by the RF signal source 340 (e.g., by controlling the bias and/or supply voltages provided by the power supply and bias circuitry 350), to adjust the state of the variable impedance matching network 360, and/or to determine when the defrosting operation should be terminated. The weight sensor(s) are positioned under the load 316, and are configured to provide an estimate of the weight of the load 316 to the system controller 330. The system controller 330 may use this information, for example, to determine a desired power level for the RF signal supplied by the RF signal source 340, to determine an initial setting for the variable impedance matching network 360, and/or to determine an approximate duration for the defrosting operation.

As discussed above, the variable impedance matching network 360 is used to match the input impedance of the defrosting cavity 310 plus load 316 to maximize, to the extent possible, the RF power transfer into the load 316. The initial impedance of the defrosting cavity 310 and the load 316 may not be known with accuracy at the beginning of a defrosting operation. Further, the impedance of the load 316 changes during a defrosting operation as the load 316 warms up. According to an embodiment, the system controller 330 may provide control signals to the variable impedance matching network 360, which cause modifications to the state of the variable impedance matching network 360. This enables the system controller 330 to establish an initial state of the variable impedance matching network 360 at the beginning of the defrosting operation that has a relatively low reflected to forward power ratio or reflected power magnitude, and thus a relatively high absorption of the RF power by the load 316. In addition, this enables the system controller 330 to modify the state of the variable impedance matching network 360 so that an adequate match may be maintained throughout the defrosting operation, despite changes in the impedance of the load 316.

According to an embodiment, the variable impedance matching network 360 may include a network of passive components, and more specifically a network of fixed-value inductors (e.g., lumped inductive components) and variable inductors (or variable inductance networks). As used herein, the term "inductor" means a discrete inductor or a set of inductive components that are electrically coupled together without intervening components of other types (e.g., resistors or capacitors).

Figure 4:
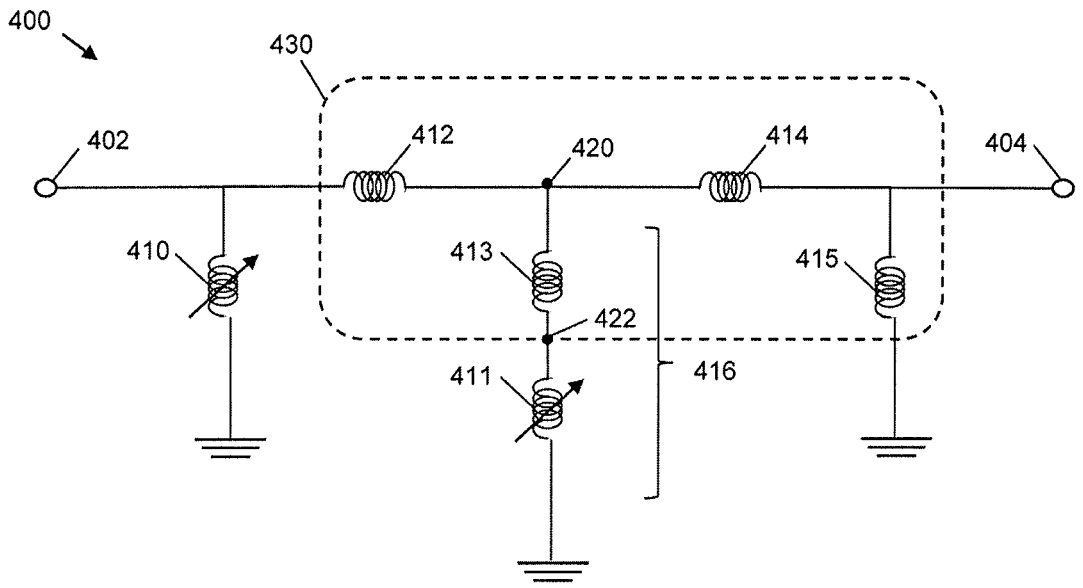
FIG. 4 is a schematic diagram of a variable inductance matching network, in accordance with an example embodiment.

FIG. 4 is a schematic diagram of a variable impedance matching network 400 (e.g., variable impedance matching network 360, FIG. 3), in accordance with an example embodiment. As will be explained in more detail below, the variable impedance matching network 360 essentially has two portions: one portion to match the RF signal source (or the final stage power amplifier); and another portion to match the cavity plus load.

Variable impedance matching network 400 includes an input node 402, an output node 404, first and second variable inductance networks 410, 411, and a plurality of fixed-value inductors 412-415, according to an embodiment. When incorporated into a defrosting system (e.g., system 300, FIG. 3), the input node 402 is electrically coupled to an output of the RF signal source (e.g., RF signal source 340, FIG. 3), and the output node 404 is electrically coupled to an electrode (e.g., electrode 370, 770, 1704, 1706, 1708, 1812, FIGS. 3, 7, 17, 18 or electrode 772, 1504, 1604, FIGS. 7, 15, 16) within the defrosting cavity (e.g., defrosting cavity 310, 774, 1806, FIGS. 3, 7, 18).

Between the input and output nodes 402, 404, the variable impedance matching network 400 includes first and second, series coupled fixed-value inductors 412, 414, in an embodiment. The first and second fixed-value inductors 412, 414 are relatively large in both size and inductance value, in an embodiment, as they may be designed for relatively low frequency (e.g., about 4.66 MHz to about 4.68 MHz) and high power (e.g., about 50 watts (W) to about 500 W) operation. For example, inductors 412, 414 may have values in a range of about 200 nanohenries (nH) to about 600 nH, although their values may be lower and/or higher, in other embodiments.

The first variable inductance network 410 is a first shunt inductive network that is coupled between the input node 402 and a ground reference terminal (e.g., the grounded containment structure 312, FIG. 3). According to an embodiment, the first variable inductance network 410 is configurable to match the impedance of the RF signal source (e.g., RF signal source 340, FIG. 3), or more particularly to match the final stage power amplifier (e.g., amplifier 346, FIG. 3). Accordingly, the first variable inductance network 410 may be referred to as the "power amplifier matching portion" of the variable impedance matching network 400. According to an embodiment, and as will be described in more detail in conjunction with FIG. 5, the first variable inductance network 410 includes a network of inductive components that may be selectively coupled together to provide inductances in a range of about 20 nH to about 400 nH, although the range may extend to lower or higher inductance values, as well.

In contrast, the "cavity matching portion" of the variable impedance matching network 400 is provided by a second shunt inductive network 416 that is coupled between a node 420 between the first and second fixed-value inductors 412, 414 and the ground reference terminal. According to an embodiment, the second shunt inductive network 416 includes a third fixed value inductor 413 and a second variable inductance network 411 coupled in series, with an intermediate node 422 between the third fixed-value inductor 413 and the second variable inductance network 411. Because the state of the second variable inductance network 411 may be changed to provide multiple inductance values, the second shunt inductive network 416 is configurable to optimally match the impedance of the cavity plus load (e.g., cavity 310 plus load 316, FIG. 3). For example, inductor 413 may have a value in a range of about 400 nH to about 800 nH, although its value may be lower and/or higher, in other embodiments. According to an embodiment, and as will be described in more detail in conjunction with FIG. 5, the second variable inductance network 411 includes a network of inductive components that may be selectively coupled together to provide inductances in a range of about 50 nH to about 800 nH, although the range may extend to lower or higher inductance values, as well.

Finally, the variable impedance matching network 400 includes a fourth fixed-value inductor 415 coupled between the output node 404 and the ground reference terminal. For example, inductor 415 may have a value in a range of about 400 nH to about 800 nH, although its value may be lower and/or higher, in other embodiments.

As will be described in more detail in conjunction with FIGS. 7 and 8, the set 430 of fixed-value inductors 412-415 may be physically located within the cavity (e.g., cavity 310, FIG. 3), or at least within the confines of the containment structure (e.g., containment structure 312, FIG. 3). This enables the radiation produced by the fixed-value inductors 412-415 to be contained within the system, rather than being radiated out into the surrounding environment. In contrast, the variable inductance networks 410, 411 may or may not be contained within the cavity or the containment structure, in various embodiments.

According to an embodiment, the variable impedance matching network 400 embodiment of FIG. 4 includes "only inductors" to provide a match for the input impedance of the defrosting cavity 310 plus load 316. Thus, the network 400 may be considered an "inductor-only" matching network. As used herein, the phrases "only inductors" or "inductor-only" when describing the components of the variable impedance matching network means that the network does not include discrete resistors with significant resistance values or discrete capacitors with significant capacitance values. In some cases, conductive transmission lines between components of the matching network may have minimal resistances, and/or minimal parasitic capacitances may be present within the network. Such minimal resistances and/or minimal parasitic capacitances are not to be construed as converting embodiments of the "inductor-only" network into a matching network that also includes resistors and/or capacitors. Those of skill in the art would understand, however, that other embodiments of variable impedance matching networks may include differently configured inductor-only matching networks, and matching networks that include combinations of discrete inductors, discrete capacitors, and/or discrete resistors. As will be described in more detail in conjunction with FIG. 6, an "inductor-only" matching network alternatively may be defined as a matching network that enables impedance matching of a capacitive load using solely or primarily inductive components.

Figure 5:
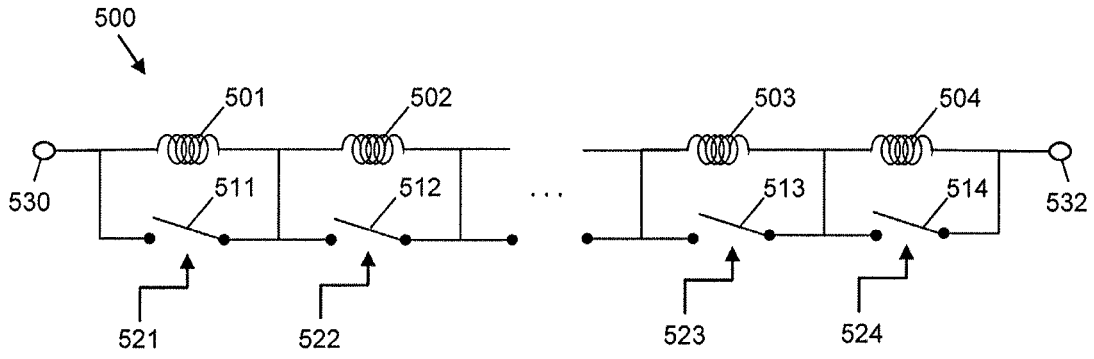
FIG. 5 is a schematic diagram of a variable inductance network, in accordance with an example embodiment.

FIG. 5 is a schematic diagram of a variable inductance network 500 that may be incorporated into a variable impedance matching network (e.g., as variable inductance networks 410 and/or 411, FIG. 4), in accordance with an example embodiment. Network 500 includes an input node 530, an output node 532, and a plurality, N, of discrete inductors 501-504 coupled in series with each other between the input and output nodes 530, 523, where N may be an integer between 2 and 10, or more. In addition, network 500 includes a plurality, N, of switches 511-514, where each switch 511-514 is coupled in parallel across the terminals of one of the inductors 501-504. Switches 511-514 may be implemented as transistors, mechanical relays or mechanical switches, for example. The electrically conductive state of each switch 511-514 (i.e., open or closed) is controlled using control signals 521-524 from the system controller (e.g., system controller 330, FIG. 3).

For each parallel inductor/switch combination, substantially all current flows through the inductor when its corresponding switch is in an open or non-conductive state, and substantially all current flows through the switch when the switch is in a closed or conductive state. For example, when all switches 511-514 are open, as illustrated in FIG. 5, substantially all current flowing between input and output nodes 530, 532 flows through the series of inductors 501-504. This configuration represents the maximum inductance state of the network 500 (i.e., the state of network 500 in which a maximum inductance value is present between input and output nodes 530, 532). Conversely, when all switches 511-514 are closed, substantially all current flowing between input and output nodes 530, 532 bypasses the inductors 501-504 and flows instead through the switches 511-514 and the conductive interconnections between nodes 530, 532 and switches 511-514. This configuration represents the minimum inductance state of the network 500 (i.e., the state of network 500 in which a minimum inductance value is present between input and output nodes 530, 532). Ideally, the minimum inductance value would be near zero inductance. However, in practice a "trace" inductance is present in the minimum inductance state due to the cumulative inductances of the switches 511-514 and the conductive interconnections between nodes 530, 532 and the switches 511-514. For example, in the minimum inductance state, the trace inductance for the variable inductance network 500 may be in a range of about 20 nH to about 50 nH, although the trace inductance may be smaller or larger, as well. Larger, smaller, or substantially similar trace inductances also may be inherent in each of the other network states, as well, where the trace inductance for any given network state is a summation of the inductances of the sequence of conductors and switches through which the current primarily is carried through the network 500.

Starting from the maximum inductance state in which all switches 511-514 are open, the system controller may provide control signals 521-524 that result in the closure of any combination of switches 511-514 in order to reduce the inductance of the network 500 by bypassing corresponding combinations of inductors 501-504. In one embodiment, each inductor 501-504 has substantially the same inductance value, referred to herein as a normalized value of I. For example, each inductor 501-504 may have a value in a range of about 100 nH to about 200 nH, or some other value. In such an embodiment, the maximum inductance value for the network 500 (i.e., when all switches 511-514 are in an open state) would be about N×I, plus any trace inductance that may be present in the network 500 when it is in the maximum inductance state. When any n switches are in a closed state, the inductance value for the network 500 would be about (N−n)×I (plus trace inductance). In such an embodiment, the state of the network 500 may be configured to have any of N+1 values of inductance.

In an alternate embodiment, the inductors 501-504 may have different values from each other. For example, moving from the input node 530 toward the output node 532, the first inductor 501 may have a normalized inductance value of I, and each subsequent inductor 502-504 in the series may have a larger or smaller inductance value. For example, each subsequent inductor 502-504 may have an inductance value that is a multiple (e.g., about twice) the inductance value of the nearest downstream inductor 501-503, although the difference may not necessarily be an integer multiple. In such an embodiment, the state of the network 500 may be configured to have any of $2^N$ values of inductance. For example, when N=4 and each inductor 501-504 has a different value, the network 500 may be configured to have any of 16 values of inductance. For example but not by way of limitation, assuming that inductor 501 has a value of I, inductor 502 has a value of 2×I, inductor 503 has a value of 4×I, and inductor 504 has a value of 8×I, Table 1—Total inductance values for all possible variable inductance network states, below indicates the total inductance value for all 16 possible states of the network 500 (not accounting for trace inductances):

TABLE 1

Total inductance values for all possible variable inductance network states

| Network state | Switch 511 state (501 value = I) | Switch 512 state (502 value = 2 × I) | Switch 513 state (503 value = 4 × I) | Switch 514 state (504 value = 8 × I) | Total network inductance (w/o trace inductance) |
|---|---|---|---|---|---|
| 0 | closed | closed | closed | closed | 0 |
| 1 | open | closed | closed | closed | I |
| 2 | closed | open | closed | closed | 2 × I |
| 3 | open | open | closed | closed | 3 × I |
| 4 | closed | closed | open | closed | 4 × I |
| 5 | open | closed | open | closed | 5 × I |
| 6 | closed | open | open | closed | 6 × I |
| 7 | open | open | open | closed | 7 × I |
| 8 | closed | closed | closed | open | 8 × I |
| 9 | open | closed | closed | open | 9 × I |
| 10 | closed | open | closed | open | 10 × I |
| 11 | open | open | closed | open | 11 × I |
| 12 | closed | closed | open | open | 12 × I |
| 13 | open | closed | open | open | 13 × I |
| 14 | closed | open | open | open | 14 × I |
| 15 | open | open | open | open | 15 × I |

Referring again to FIG. 4, an embodiment of variable inductance network 410 may be implemented in the form of variable inductance network 500 with the above-described example characteristics (i.e., N=4 and each successive inductor is about twice the inductance of the preceding inductor). Assuming that the trace inductance in the minimum inductance state is about 20 nH, and the range of inductance values achievable by network 410 is about 20 nH (trace inductance) to about 400 nH, the values of inductors 501-504 may be, for example, about 30 nH, about 50 nH, about 100 nH, and about 200 nH, respectively. Similarly, if an embodiment of variable inductance network 411 is implemented in the same manner, and assuming that the trace inductance is about 50 nH and the range of inductance values achievable by network 411 is about 50 nH (trace inductance) to about 800 nH, the values of inductors 501-504 may be, for example, about 50 nH, about 100 nH, about 200 nH, and about 400 nH, respectively. Of course, more or fewer than four inductors 501-504 may be included in either variable inductance network 410, 411, and the inductors within each network 410, 411 may have different values.

Although the above example embodiment specifies that the number of switched inductances in the network 500 equals four, and that each inductor 501-504 has a value that is some multiple of a value of I, alternate embodiments of variable inductance networks may have more or fewer than four inductors, different relative values for the inductors, a different number of possible network states, and/or a different configuration of inductors (e.g., differently connected sets of parallel and/or series coupled inductors). Either way, by providing a variable inductance network in an impedance matching network of a defrosting system, the system may be better able to match the ever-changing cavity input impedance that is present during a defrosting operation.

Figure 6:
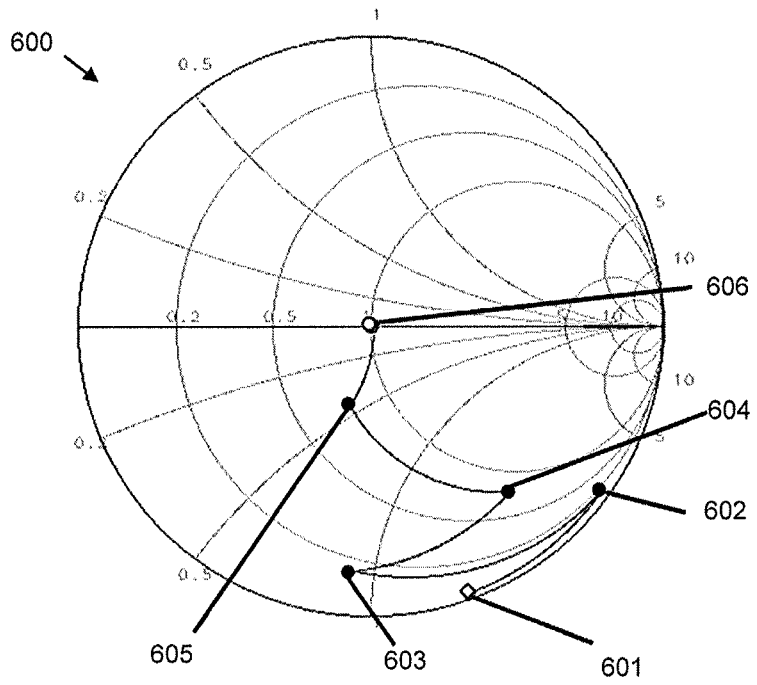
FIG. 6 is an example of a Smith chart depicting how a plurality of inductances in an embodiment of a variable impedance matching network may match the input cavity impedance to an RF signal source.

FIG. 6 is an example of a Smith chart 600 depicting how the plurality of inductances in an embodiment of a variable impedance matching network (e.g., network 360, 400, FIGS. 3, 4) may match the input cavity impedance to the RF signal source. The example Smith chart 600 assumes that the system is a 50 Ohm system, and that the output of the RF signal source is 50 Ohms. Those of skill in the art would understand, based on the description herein, how the Smith chart could be modified for a system and/or RF signal source with different characteristic impedances.

In Smith chart 600, point 601 corresponds to the point at which the load (e.g., the cavity 310 plus load 316, FIG. 3) would locate (e.g., at the beginning of a defrosting operation) absent the matching provided by the variable impedance matching network (e.g., network 360, 400, FIGS. 3, 4). As indicated by the position of the load point 601 in the lower right quadrant of the Smith chart 600, the load is a capacitive load. According to an embodiment, the shunt and series inductances of the variable impedance matching network sequentially move the substantially-capacitive load impedance toward an optimal matching point 606 (e.g., 50 Ohms) at which RF energy transfer to the load may occur with minimal losses. More specifically, and referring also to FIG. 4, shunt inductance 415 moves the impedance to point 602, series inductance 414 moves the impedance to point 603, shunt inductance 416 moves the impedance to point 604, series inductance 412 moves the impedance to point 605, and shunt inductance 410 moves the impedance to the optimal matching point 606.

It should be noted that the combination of impedance transformations provided by embodiments of the variable impedance matching network keep the impedance at any point within or very close to the lower right quadrant of the Smith chart 600. As this quadrant of the Smith chart 600 is characterized by relatively high impedances and relatively low currents, the impedance transformation is achieved without exposing components of the circuit to relatively high and potentially damaging currents. Accordingly, an alternate definition of an "inductor-only" matching network, as used herein, may be a matching network that enables impedance matching of a capacitive load using solely or primarily inductive components, where the impedance matching network performs the transformation substantially within the lower right quadrant of the Smith chart.

As discussed previously, the impedance of the load changes during the defrosting operation. Accordingly, point 601 correspondingly moves during the defrosting operation. Movement of load point 601 is compensated for, according to the previously-described embodiments, by varying the impedance of the first and second shunt inductances 410, 411 so that the final match provided by the variable impedance matching network still may arrive at or near the optimal matching point 606. Although a specific variable impedance matching network has been illustrated and described herein, those of skill in the art would understand, based on the description herein, that differently-configured variable impedance matching networks may achieve the same or similar results to those conveyed by Smith chart 600. For example, alternative embodiments of a variable impedance matching network may have more or fewer shunt and/or series inductances, and or different ones of the inductances may be configured as variable inductance networks (e.g., including one or more of the series inductances). Accordingly, although a particular variable inductance matching network has been illustrated and described herein, the inventive subject matter is not limited to the illustrated and described embodiment.

A particular physical configuration of a defrosting system will now be described in conjunction with FIGS. 7 and 8. More particularly, FIG. 7 is a cross-sectional, side view of a defrosting system 700, in accordance with an example embodiment, and FIG. 8 is a perspective view of a portion of defrosting system 700. It should be noted that some portions the defrosting system 700 shown in FIGS. 7 and 8 may not be drawn to scale so that components of the defrosting system 700 may be depicted more clearly. The defrosting system 700 generally includes a defrosting cavity 774 (sometimes referred to herein as air cavity 774), a user interface (not shown), a system controller 730, an RF signal source 740, power supply and bias circuitry (not shown), power detection circuitry 780, a variable impedance matching network 760, a first electrode 770, and a second electrode 772 (e.g., electrode 1504, 1604, FIGS. 15, 16), and a drawer 721 (e.g., drawer 218, 228, 321, 1110, 1210, 1412, 1802, FIGS. 2, 3, 11, 12, 14, 18) in an embodiment. In addition, in some embodiments, defrosting system 700 may include weight sensor(s) 790, temperature sensor(s), and/or IR sensor(s) 792.

The defrosting system 700 is contained within a containment structure 750, in an embodiment. According to an embodiment, the containment structure 750 may define three interior areas: the defrosting cavity 774 (e.g., cavity 310, 1806, FIGS. 3, 18), a fixed inductor area 776, and a circuit housing area 778. The containment structure 750 includes bottom, top, and side walls. Portions of the interior surfaces of some of the walls of the containment structure 750 may define the defrosting cavity 774 and, for instances in which drawer 721 is conductive, may be formed from side walls or the bottom wall (e.g., "platform") of drawer 721 (e.g., any one or more of walls 1112, 1122, 1132, 1212, 1222, 1232, FIGS. 11, 12). The defrosting cavity 774 includes a capacitive defrosting arrangement with first and second parallel plate electrodes 770, 772 that are separated by an air cavity 774 within which a load 716 to be defrosted may be placed. For example, the first electrode 770 (e.g., electrode 370, 1704, 1706, 1708, 1812, FIGS. 3, 17, 18) may be positioned above the air cavity 774, and a second electrode 772 (e.g., electrode 1504, 1604, FIGS. 15, 16) may be provided by a conductive portion of the drawer 721 (e.g., a portion of the bottom wall or platform of the drawer 721, which in some embodiments may be referred to as a second structure). Alternatively, the second electrode 772 may be formed from a conductive plate that is distinct from the containment structure 750. First electrode 770 may be formed as part of a shelf (e.g., shelf 216, 226, 1426, 1804, FIGS. 2, 14, 18, which in some embodiments may be referred to as a first structure) into which drawer 721 may be inserted or with which drawer 721 may be otherwise physically engaged. According to an embodiment, non-electrically conductive support structure(s) 754 may be employed to suspend the first electrode 770 above the air cavity, to electrically isolate the first electrode 770 from the containment structure 750, and to hold the first electrode 770 in a fixed physical orientation with respect to the air cavity 774. While drawer 721 is shown here to have sidewalls, it should be noted that in some embodiments drawer 721 may be a substantially flat platform without sidewalls and may be configured to be inserted beneath first electrode 770 (e.g., by inserting rails of drawer 721 into corresponding channels of containment structure 750, where at least one of the rails of drawer 721 is permanently electrically coupled to second electrode 772 or alternatively by inserting rails of containment structure 750 into corresponding channels of drawer 721, where at least one of the channels of drawer 721 is permanently electrically coupled to second electrode 772).

According to an embodiment, the containment structure 750 is at least partially formed from conductive material, and the conductive portion(s) of the containment structure may be grounded to provide a ground reference for various electrical components of the system. Alternatively, at least the portion of the drawer 721 that corresponds to the second electrode 772 may be formed from conductive material and grounded. To avoid direct contact between the load 716 and the second electrode 772, a non-conductive barrier 756 may be positioned over the second electrode 772.

When included in the system 700, the weight sensor(s) 790 may be positioned under the load 716 directly, or may be positioned directly under drawer 721. The weight sensor(s) 790 are configured to provide an estimate of the weight of the load 716 to the system controller 730. The temperature sensor(s) and/or IR sensor(s) 792 may be positioned in locations that enable the temperature of the load 716 to be sensed both before, during, and after a defrosting operation. According to an embodiment, the temperature sensor(s) and/or IR sensor(s) 792 are configured to provide load temperature estimates to the system controller 730.

Some or all of the various components of the system controller 730, the RF signal source 740, the power supply and bias circuitry (not shown), the power detection circuitry 780, and portions 710, 711 of the variable impedance matching network 760, may be coupled to a common substrate 752 within the circuit housing area 778 of the containment structure 750, in an embodiment. According to an embodiment, the system controller 730 is coupled to the user interface, RF signal source 740, variable impedance matching network 760, and power detection circuitry 780 through various conductive interconnects on or within the common substrate 752. In addition, the power detection circuitry 780 is coupled along the transmission path 748 between the output of the RF signal source 740 and the input 702 to the variable impedance matching network 760, in an embodiment. For example, the substrate 752 may include a microwave or RF laminate, a polytetrafluorethylene (PTFE) substrate, a printed circuit board (PCB) material substrate (e.g., FR-4), an alumina substrate, a ceramic tile, or another type of substrate. In various alternate embodiments, various ones of the components may be coupled to different substrates with electrical interconnections between the substrates and components. In still other alternate embodiments, some or all of the components may be coupled to a cavity wall, rather than being coupled to a distinct substrate.

The first electrode 770 is electrically coupled to the RF signal source 740 through a variable impedance matching network 760 and a transmission path 748, in an embodiment. As discussed previously, the variable impedance matching network 760 includes variable inductance networks 710, 711 (e.g., networks 410, 411, FIG. 4) and a plurality of fixed-value inductors 712-715 (e.g., inductors 412-415, FIG. 4). In an embodiment, the variable inductance networks 710, 711 are coupled to the common substrate 752 and located within the circuit housing area 778. In contrast, the fixed-value inductors 712-715 are positioned within the fixed inductor area 776 of the containment structure 750 (e.g., between the common substrate 752 and the first electrode 770). Conductive structures (e.g., conductive vias or other structures) may provide for electrical communication between the circuitry within the circuit housing area 778 and the fixed-value inductors 712-715 within the fixed inductor area 776.

Figure 7:
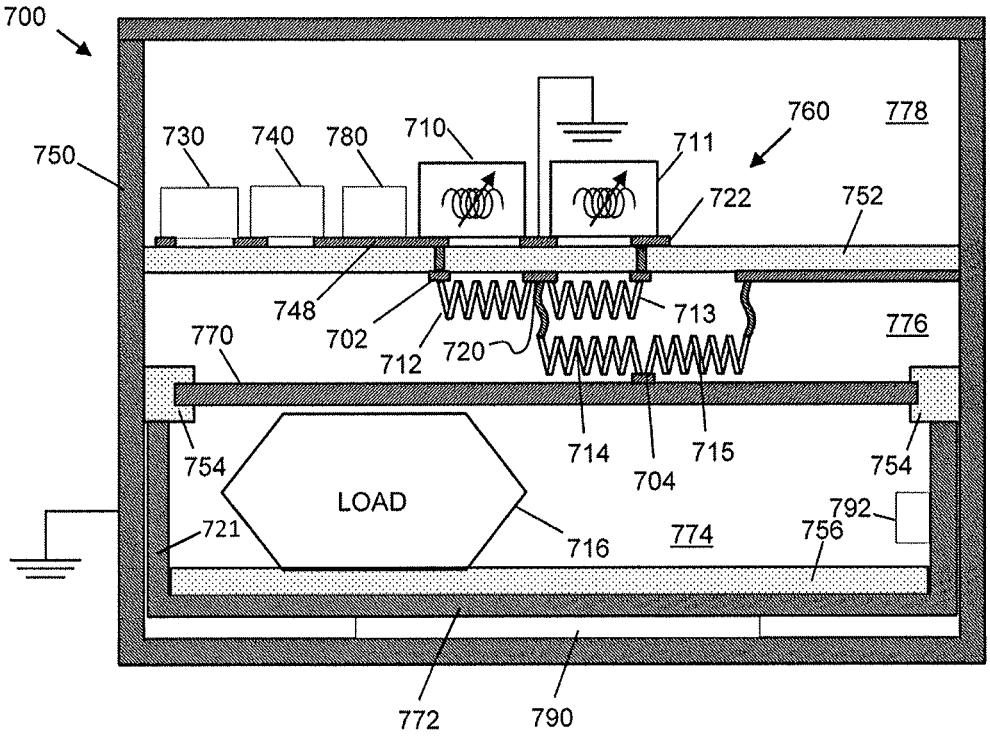
FIG. 7 is a cross-sectional, side view of a defrosting system, in accordance with an example embodiment.
Figure 8:
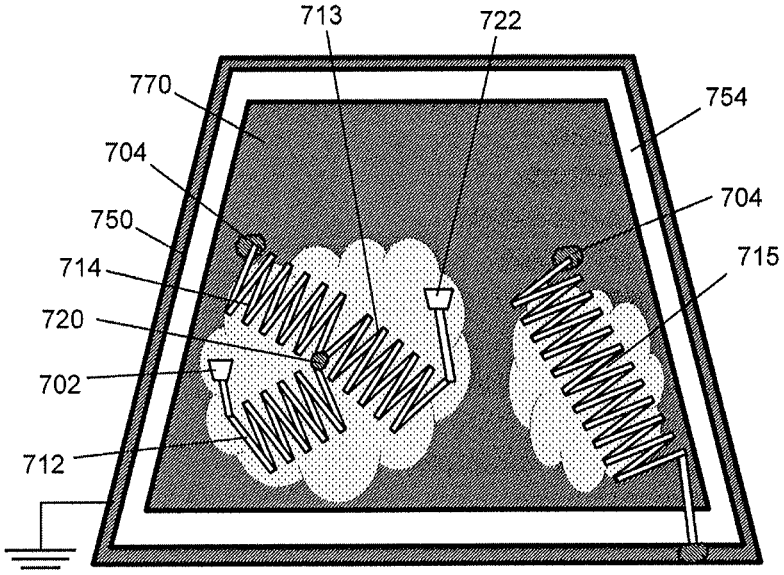
FIG. 8 is a perspective view of a portion of a defrosting system, in accordance with an example embodiment.

For enhanced understanding of the system 700, the nodes and components of the variable impedance matching network 760 depicted in FIGS. 7 and 8 will now be correlated with nodes and components of the variable impedance matching network 400 depicted in FIG. 4. More specifically, the variable impedance matching network 760 includes an input node 702 (e.g., input node 402, FIG. 4), an output node 704 (e.g., output node 404, FIG. 4), first and second variable inductance networks 710, 711 (e.g., variable inductance networks 410, 411, FIG. 4), and a plurality of fixed-value inductors 712-715 (e.g., inductors 412-415, FIG. 4), according to an embodiment. The input node 702 is electrically coupled to an output of the RF signal source 740 through various conductive structures (e.g., conductive vias and traces), and the output node 704 is electrically coupled to the first electrode 770.

Between the input and output nodes 702, 704 (e.g., input and output nodes 402, 404, FIG. 4), system 700 includes four fixed-value inductors 712-715 (e.g., inductors 412-415, FIG. 4), in an embodiment, which are positioned within the fixed inductor area 776. An enhanced understanding of an embodiment of a physical configuration of the fixed-value inductors 712-715 within the fixed inductor area 776 may be achieved by referring to both FIG. 7 and to FIG. 8 simultaneously, where FIG. 8 depicts a top perspective view of the fixed inductor area 776. In FIG. 8, the irregularly shaped, shaded areas underlying inductors 712-715 represents suspension of the inductors 712-715 in space over the first electrode 770. In other words, the shaded areas indicate where the inductors 712-715 are electrically insulated from the first electrode 770 by air. Rather than relying on an air dielectric, non-electrically conductive spacers may be included in these areas.

In an embodiment, the first fixed-value inductor 712 has a first terminal that is electrically coupled to the input node 702 (and thus to the output of RF signal source 740), and a second terminal that is electrically coupled to a first intermediate node 720 (e.g., node 420, FIG. 4). The second fixed-value inductor 713 has a first terminal that is electrically coupled to the first intermediate node 720, and a second terminal that is electrically coupled to a second intermediate node 722 (e.g., node 422, FIG. 4). The third fixed-value inductor 714 has a first terminal that is electrically coupled to the first intermediate node 720, and a second terminal that is electrically coupled to the output node 704 (and thus to the first electrode 770). The fourth fixed-value inductor 715 has a first terminal that is electrically coupled to the output node 704 (and thus to the first electrode 770), and a second terminal that is electrically coupled to a ground reference node (e.g., to the grounded containment structure 750 through one or more conductive interconnects).

The first variable inductance network 710 (e.g., network 410, FIG. 4) is electrically coupled between the input node 702 and a ground reference terminal (e.g., the grounded containment structure 750). Finally, the second shunt inductive network 711 is electrically coupled between the second intermediate node 722 and the ground reference terminal.

Figure 9:
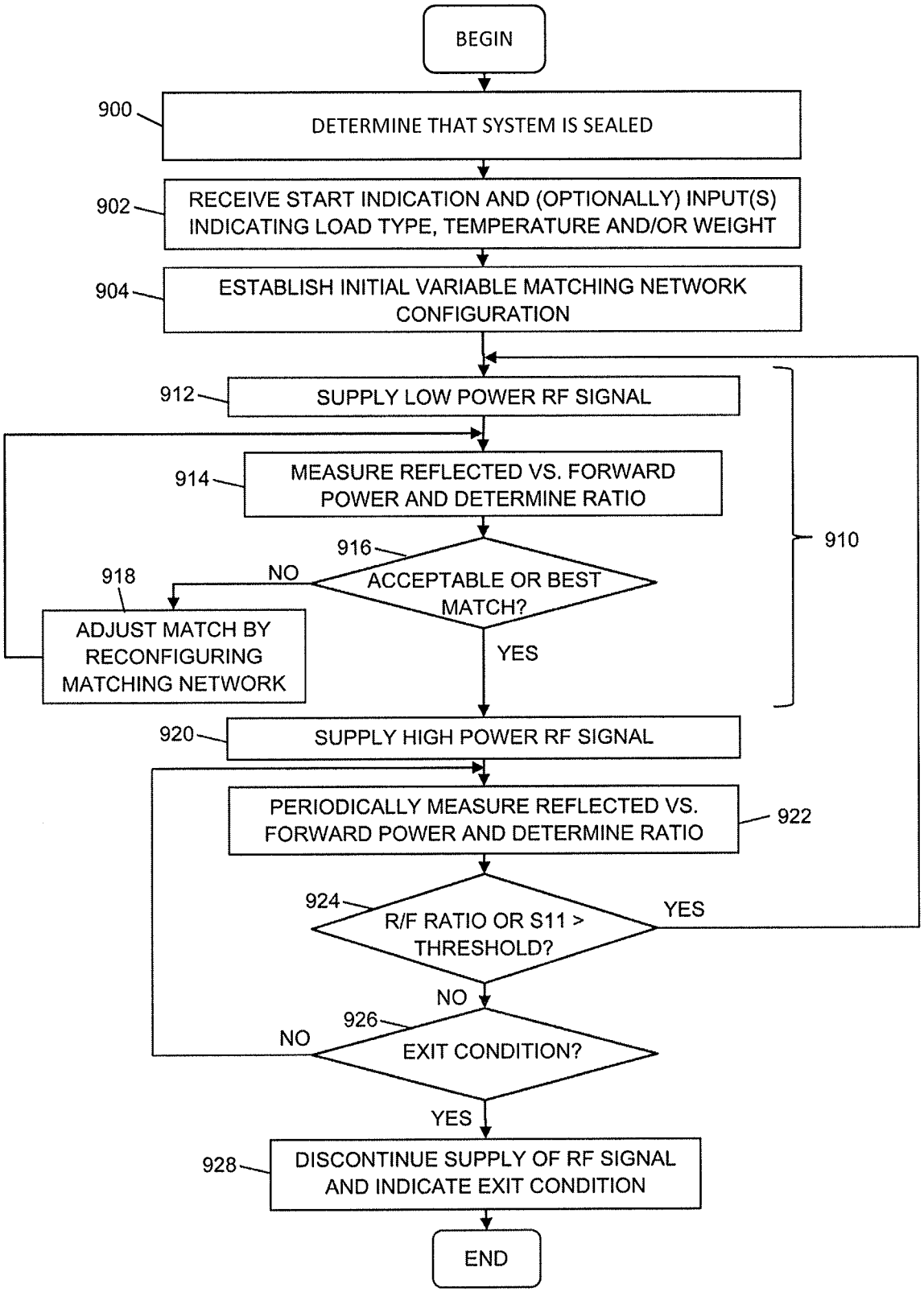
FIG. 9 is a flowchart of a method of operating a defrosting system with dynamic load matching, in accordance with an example embodiment.

Now that embodiments of the electrical and physical aspects of defrosting systems have been described, various embodiments of methods for operating such defrosting systems will now be described. More specifically, FIG. 9 is a flowchart of a method of operating a defrosting system (e.g., system 100, 210, 220, 300, 700, FIGS. 1-3, 7) with dynamic load matching, in accordance with an example embodiment.

The method may begin, in block 900, when a user places a load (e.g., load 316, FIG. 3) into the system's defrosting cavity (e.g., cavity 310, FIG. 3, corresponding to one of drawers 1110, 1210, 1412, 1802, FIGS. 11, 12, 14, 18), and seals the cavity (e.g., by closing the drawer). In an embodiment, sealing of the cavity may engage one or more safety interlock mechanisms, which when engaged, indicate that RF power supplied to the cavity will not substantially leak into the environment outside of the cavity. As will be described later, disengagement of a safety interlock mechanism may cause the system controller immediately to pause or terminate the defrosting operation.

In block 900, the system controller (e.g., system controller 330, FIG. 3) receives an indication that the system has been sealed. For example, the system (e.g., the defrosting cavity of the system) may be sealed by fully inserting a drawer (e.g., drawer 218, 228, 321, 721, 1110, 1210, 1412, 1802, FIGS. 2, 3, 7 11, 12, 14, 18) into a containment structure (e.g., such that the drawer is physically engaged with the containment structure) under a shelf (e.g., shelf 216, 226, 1426, 1804, FIGS. 2, 14, 18) which may form a portion of the containment structure, or by closing a door (e.g., door 116, FIG. 1) after the drawer has been fully inserted into the containment structure to fully enclose the cavity. This indication may be, for example, an electrical signal provided by a safety interlock disposed in or on the containment structure.

In block 902, the system controller (e.g., system controller 330, FIG. 3) receives an indication that a defrosting operation should start. Such an indication may be received, for example, when the user has pressed a start button (e.g., of the user interface 320, FIG. 3). According to various embodiments, the system controller optionally may receive additional inputs indicating the load type (e.g., meats, liquids, or other materials), the initial load temperature, and/or the load weight. For example, information regarding the load type may be received from the user through interaction with the user interface (e.g., by the user selecting from a list of recognized load types). Alternatively, the system may be configured to scan a barcode visible on the exterior of the load, or to receive an electronic signal from an RFID device on or embedded within the load. Information regarding the initial load temperature may be received, for example, from one or more temperature sensors and/or IR sensors (e.g., sensors 390, 792, FIGS. 3, 7) of the system. Information regarding the load weight may be received from the user through interaction with the user interface, or from a weight sensor (e.g., sensor 390, 790, FIGS. 3, 7) of the system. As indicated above, receipt of inputs indicating the load type, initial load temperature, and/or load weight is optional, and the system alternatively may not receive some or all of these inputs.

In block 904, the system controller provides control signals to the variable matching network (e.g., network 360, 400, FIGS. 3, 4) to establish an initial configuration or state for the variable matching network. As described in detail in conjunction with FIGS. 4 and 5, the control signals affect the inductances of variable inductance networks (e.g., networks 410, 411, FIG. 4) within the variable matching network. For example, the control signals may affect the states of bypass switches (e.g., switches 511-514, FIG. 5), which are responsive to the control signals from the system controller (e.g., control signals 521-524, FIG. 5).

As also discussed previously, a first portion of the variable matching network may be configured to provide a match for the RF signal source (e.g., RF signal source 340, FIG. 3) or the final stage power amplifier (e.g., power amplifier 346, FIG. 3), and a second portion of the variable matching network may be configured to provide a match for the cavity (e.g., cavity 310, FIG. 3) plus the load (e.g., load 316, FIG. 3). For example, referring to FIG. 4, a first shunt, variable inductance network 410 may be configured to provide the RF signal source match, and a second shunt, variable inductance network 416 may be configured to provide the cavity plus load match.

Figure 10:
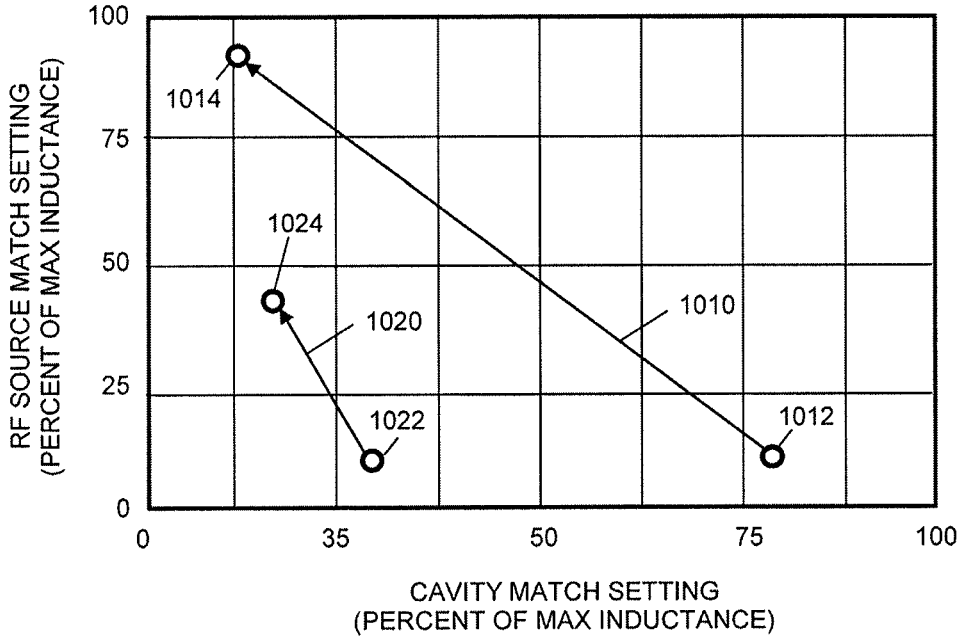
FIG. 10 is a chart plotting cavity match setting versus RF signal source match setting through a defrost operation for two different loads.

It has been observed that a best initial overall match for a frozen load (i.e., a match at which a maximum amount of RF power is absorbed by the load) typically has a relatively high inductance for the cavity matching portion of the matching network, and a relatively low inductance for the RF signal source matching portion of the matching network. For example, FIG. 10 is a chart plotting optimal cavity match setting versus RF signal source match setting through a defrost operation for two different loads, where trace 1010 corresponds to a first load (e.g., having a first type, weight, and so on), and trace 1020 corresponds to a second load (e.g., having a second type, weight, and so on). In FIG. 10, the optimal initial match settings for the two loads at the beginning of a defrost operation (e.g., when the loads are frozen) are indicated by points 1012 and 1022, respectively. As can be seen, both points 1012 and 1022 indicate relatively high cavity match settings in comparison to relatively low RF source match settings. Referring to the embodiment of FIG. 4, this translates to a relatively high inductance for variable inductance network 416, and a relatively low inductance for variable inductance network 410.

According to an embodiment, to establish the initial configuration or state for the variable matching network in block 904, the system controller sends control signals to the first and second variable inductance networks (e.g., networks 410, 411, FIG. 4) to cause the variable inductance network for the RF signal source match (e.g., network 410) to have a relatively low inductance, and to cause the variable inductance network for the cavity match (e.g., network 411) to have a relatively high inductance. The system controller may determine how low or how high the inductances are set based on load type/weight/temperature information known to the system controller a priori. If no a priori load type/weight/temperature information is available to the system controller, the system controller may select a relatively low default inductance for the RF signal source match and a relatively high default inductance for the cavity match.

Assuming, however, that the system controller does have a priori information regarding the load characteristics, the system controller may attempt to establish an initial configuration near the optimal initial matching point. For example, and referring again to FIG. 10, the optimal initial matching point 1012 for the first type of load has a cavity match (e.g., implemented by network 411) of about 80 percent of the network's maximum value, and has an RF signal source match (e.g., implemented by network 410) of about 10 percent of the network's maximum value. Assuming each of the variable inductance networks has a structure similar to the network 500 of FIG. 5, for example, and assuming that the states from Table 1—Total inductance values for all possible variable inductance network states, above, apply, then for the first type of load, system controller may initialize the variable inductance network so that the cavity match network (e.g., network 411) has state 12 (i.e., about 80 percent of the maximum possible inductance of network 411), and the RF signal source match network (e.g., network 410) has state 2 (i.e., about 10 percent of the maximum possible inductance of network 410). Conversely, the optimal initial matching point 1022 for the second type of load has a cavity match (e.g., implemented by network 411) of about 40 percent of the network's maximum value, and has an RF signal source match (e.g., implemented by network 410) of about 10 percent of the network's maximum value. Accordingly, for the second type of load, system controller may initialize the variable inductance network so that the cavity match network (e.g., network 411) has state 6 (i.e., about 40 percent of the maximum possible inductance of network 411), and the RF signal source match network (e.g., network 410) has state 2 (i.e., about 10 percent of the maximum possible inductance of network 410).

Referring again to FIG. 9, once the initial variable matching network configuration is established, the system controller may perform a process 910 of adjusting, if necessary, the configuration of the variable impedance matching network to find an acceptable or best match based on actual measurements that are indicative of the quality of the match. According to an embodiment, this process includes causing the RF signal source (e.g., RF signal source 340) to supply a relatively low power RF signal through the variable impedance matching network to the first electrode (e.g., first electrode 370), in block 912. The system controller may control the RF signal power level through control signals to the power supply and bias circuitry (e.g., circuitry 350, FIG. 3), where the control signals cause the power supply and bias circuitry to provide supply and bias voltages to the amplifiers (e.g., amplifier stages 344, 346, FIG. 3) that are consistent with the desired signal power level. For example, the relatively low power RF signal may be a signal having a power level in a range of about 10 W to about 20 W, although different power levels alternatively may be used. A relatively low power level signal during the match adjustment process 910 is desirable to reduce the risk of damaging the cavity or load (e.g., if the initial match causes high reflected power), and to reduce the risk of damaging the switching components of the variable inductance networks (e.g., due to arcing across the switch contacts).

In block 914, power detection circuitry (e.g., power detection circuitry 380, FIG. 3) then measures the forward and/or reflected power along the transmission path (e.g., path 348, FIG. 3) between the RF signal source and the first electrode, and provides those measurements to the system controller. The system controller may then determine a ratio between the reflected and forward signal powers, and may determine the S11 parameter for the system based on the ratio. The system controller may store the calculated ratios and/or S11 parameters for future evaluation or comparison, in an embodiment.

In block 916, the system controller may determine, based on the reflected-to-forward signal power ratio and/or the S11 parameter and/or the reflected signal power magnitude, whether or not the match provided by the variable impedance matching network is acceptable (e.g., the ratio is 10 percent or less, or compares favorably with some other criteria). Alternatively, the system controller may be configured to determine whether the match is the "best" match. A "best" match may be determined, for example, by iteratively measuring the forward and/or reflected RF power for all possible impedance matching network configurations (or at least for a defined subset of impedance matching network configurations), and determining which configuration results in the lowest reflected-to-forward power ratio or reflected power magnitude.

When the system controller determines that the match is not acceptable or is not the best match, the system controller may adjust the match, in block 918, by reconfiguring the variable inductance matching network. For example, this may be achieved by sending control signals to the variable impedance matching network, which cause the network to increase and/or decrease the variable inductances within the network (e.g., by causing the variable inductance networks 410, 411 to have different inductance states). After reconfiguring the variable inductance network, blocks 914, 916, and 918 may be iteratively performed until an acceptable or best match is determined in block 916.

Once an acceptable or best match is determined, the defrosting operation may commence. Commencement of the defrosting operation includes increasing the power of the RF signal supplied by the RF signal source (e.g., RF signal source 340) to a relatively high power RF signal, in block 920. Once again, the system controller may control the RF signal power level through control signals to the power supply and bias circuitry (e.g., circuitry 350, FIG. 3), where the control signals cause the power supply and bias circuitry to provide supply and bias voltages to the amplifiers (e.g., amplifier stages 344, 346, FIG. 3) that are consistent with the desired signal power level. For example, the relatively high power RF signal may be a signal having a power level in a range of about 50 W to about 500 W, although different power levels alternatively may be used.

In block 922, power detection circuitry (e.g., power detection circuitry 380, FIG. 3) then periodically measures the forward and/or reflected power along the transmission path (e.g., path 348, FIG. 3) between the RF signal source and the first electrode, and provides those measurements to the system controller. The system controller again may determine a ratio between the reflected and/or forward signal powers, and may determine the S11 parameter for the system based on the ratio. The system controller may store the calculated ratios and/or S11 parameters and/or reflected power magnitudes for future evaluation or comparison, in an embodiment. According to an embodiment, the periodic measurements of the forward and/or reflected power may be taken at a fairly high frequency (e.g., on the order of milliseconds) or at a fairly low frequency (e.g., on the order of seconds). For example, a fairly low frequency for taking the periodic measurements may be a rate of one measurement every 10 seconds to 20 seconds.

In block 924, the system controller may determine, based on one or more calculated reflected-to-forward signal power ratios and/or one or more calculated S11 parameters and/or one or more reflected power magnitude measurements, whether or not the match provided by the variable impedance matching network is acceptable. For example, the system controller may use a single calculated reflected-to-forward signal power ratio or S11 parameter or reflected power measurement in making this determination, or may take an average (or other calculation) of a number of previously-calculated reflected-to-forward power ratios or S11 parameters or reflected power measurements in making this determination. To determine whether or not the match is acceptable, the system controller may compare the calculated ratio and/or S11 parameter and/or reflected power measurement to a threshold, for example. For example, in one embodiment, the system controller may compare the calculated reflected-to-forward signal power ratio to a threshold of 10 percent (or some other value). A ratio below 10 percent may indicate that the match remains acceptable, and a ratio above 10 percent may indicate that the match is no longer acceptable. When the calculated ratio or S11 parameter or reflected power measurement is greater than the threshold (i.e., the comparison is unfavorable), indicating an unacceptable match, then the system controller may initiate re-configuration of the variable impedance matching network by again performing process 910.

As discussed previously, the match provided by the variable impedance matching network may degrade over the course of a defrosting operation due to impedance changes of the load (e.g., load 316, FIG. 3) as the load warms up. It has been observed that, over the course of a defrosting operation, an optimal cavity match may be maintained by decreasing the cavity match inductance (e.g., by decreasing the inductance of variable inductance network 411, FIG. 4) and by increasing the RF signal source inductance (e.g., by increasing the inductance of variable inductance network 410, FIG. 4). Referring again to FIG. 10, for example, an optimal match for the first type of load at the end of a defrosting operation is indicated by point 1014, and an optimal match for the second type of load at the end of a defrosting operation is indicated by point 1024. In both cases, tracking of the optimal match between initiation and completion of the defrosting operations involves gradually decreasing the inductance of the cavity match and increasing the inductance of the RF signal source match.

According to an embodiment, in the iterative process 910 of re-configuring the variable impedance matching network, the system controller may take into consideration this tendency. More particularly, when adjusting the match by reconfiguring the variable impedance matching network in block 918, the system controller initially may select states of the variable inductance networks for the cavity and RF signal source matches that correspond to lower inductances (for the cavity match, or network 411, FIG. 4) and higher inductances (for the RF signal source match, or network 410, FIG. 4). By selecting impedances that tend to follow the expected optimal match trajectories (e.g., those illustrated in FIG. 10), the time to perform the variable impedance matching network reconfiguration process 910 may be reduced, when compared with a reconfiguration process that does not take these tendencies into account.

In an alternate embodiment, the system controller may instead iteratively test each adjacent configuration to attempt to determine an acceptable configuration. For example, referring again to Table 1—Total inductance values for all possible variable inductance network states, above, if the current configuration corresponds to state 12 for the cavity matching network and to state 3 for the RF signal source matching network, the system controller may test states 11 and/or 13 for the cavity matching network, and may test states 2 and/or 4 for the RF signal source matching network. If those tests do not yield a favorable result (i.e., an acceptable match), the system controller may test states 10 and/or 14 for the cavity matching network, and may test states 1 and/or 5 for the RF signal source matching network, and so on.

In actuality, there are a variety of different searching methods that the system controller may employ to re-configure the system to have an acceptable impedance match, including testing all possible variable impedance matching network configurations. Any reasonable method of searching for an acceptable configuration is considered to fall within the scope of the inventive subject matter. In any event, once an acceptable match is determined in block 916, the defrosting operation is resumed in block 920, and the process continues to iterate.

Referring back to block 924, when the system controller determines, based on one or more calculated reflected-to-forward signal power ratios and/or one or more calculated S11 parameters and/or one or more reflected power measurements, that the match provided by the variable impedance matching network is still acceptable (e.g., the calculated ratio or S11 parameter is less than the threshold, or the comparison is favorable), the system may evaluate whether or not an exit condition has occurred, in block 926. In actuality, determination of whether an exit condition has occurred may be an interrupt driven process that may occur at any point during the defrosting process. However, for the purposes of including it in the flowchart of FIG. 9, the process is shown to occur after block 924.

In any event, several conditions may warrant cessation of the defrosting operation. For example, the system may determine that an exit condition has occurred when a safety interlock is breached (e.g., the drawer has been opened). Alternatively, the system may determine that an exit condition has occurred upon expiration of a timer that was set by the user (e.g., through user interface 320, FIG. 3) or upon expiration of a timer that was established by the system controller based on the system controller's estimate of how long the defrosting operation should be performed.

If an exit condition has not occurred, then the defrosting operation may continue by iteratively performing blocks 922 and 924 (and the matching network reconfiguration process 910, as necessary). When an exit condition has occurred, then in block 928, the system controller causes the supply of the RF signal by the RF signal source to be discontinued. For example, the system controller may disable the RF signal generator (e.g., RF signal generator 342, FIG. 3) and/or may cause the power supply and bias circuitry (e.g., circuitry 350, FIG. 3) to discontinue provision of the supply current. In addition, the system controller may send signals to the user interface (e.g., user interface 320, FIG. 3) that cause the user interface to produce a user-perceptible indicia of the exit condition (e.g., by displaying "drawer open" or "done" on a display device, or providing an audible tone). The method may then end.

During the defrosting of a load, liquid may accumulate in the containment structure of a defrosting system as a result of condensation or leaking. This liquid may undesirably putrefy if left unattended for too long, which can create a need for cleaning the containment structure of the defrosting system. It therefore may be advantageous for defrosting systems to include removable drawers for easier cleaning compared to defrosting systems without removable containment structures. For example, some defrosting systems may be disposed in locations that are difficult for a consumer to reach for the length of time associated with thorough cleaning, such as on a tall shelf or close to the ground. In contrast, removable containment structures, such as the drawers discussed herein, may be moved to a location where cleaning may be performed more easily and effectively, such as a sink.

Furthermore, conventional defrosting systems generally include electrodes and containment structures having fixed sizes and shapes. However, an electrode or a containment structure having a given size and shape may not be ideal for defrosting loads having a variety of shapes and sizes. For example, defrosting a load in a containment structure that is significantly larger than the load may be inefficient with respect to the amount of power used to perform the defrosting operation. Conversely, some loads may be too large for a given containment structure to accommodate. As another example, defrosting a load using comparatively larger electrodes may result in power inefficiency as a portion of the RF energy passing between the electrodes during defrosting will not go toward heating the load. Conversely, defrosting a load using comparatively smaller electrodes may result in the load not being heated evenly or completely, as portions of the load that are not overlapped by the electrodes may not receive as much RF energy as the portions of the load that are overlapped by the electrodes. It therefore may be advantageous to use a defrosting system that is compatible with multiple drawers having different shapes and sizes and/or having electrodes of different shapes, sizes, or configurations so that loads of varying shape and size may be accommodated.

As described previously, defrosting systems (e.g., defrosting systems 210 and 220 shown in FIG. 2) may include drawers that may be slid under a fixed shelf in order to create an enclosed air cavity (e.g., resonance cavity) in which RF defrosting may take place. Each drawer may act as both a containment structure and an electrode (e.g., a grounded electrode such as electrode 772 shown in FIG. 7) for its respective defrosting system, while the fixed shelf may include a signal electrode at which an RF signal is generated for performing defrosting operations on a load in the air cavity of the defrosting system. In alternate embodiments, the drawer may include a signal electrode, and the fixed shelf may include a grounded electrode.

Figure 11A:
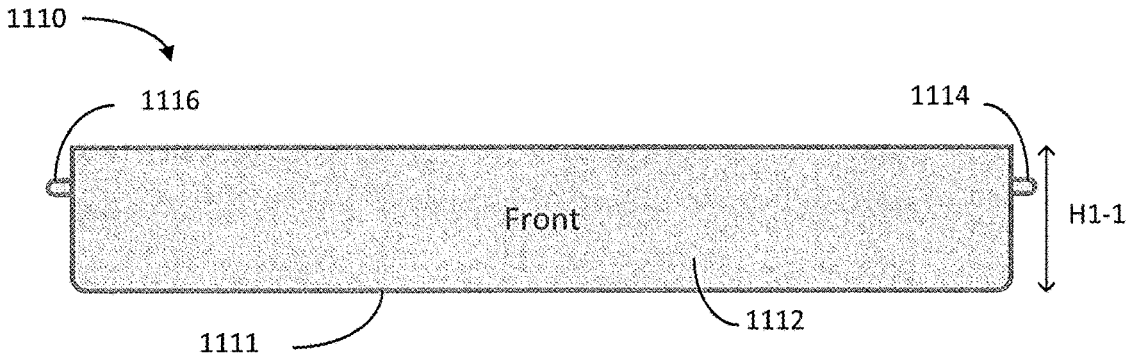
FIG. 11A is a front view of a drawer that may be used in the defrosting system of FIG. 2 in accordance with an example embodiment.
Figure 11B:
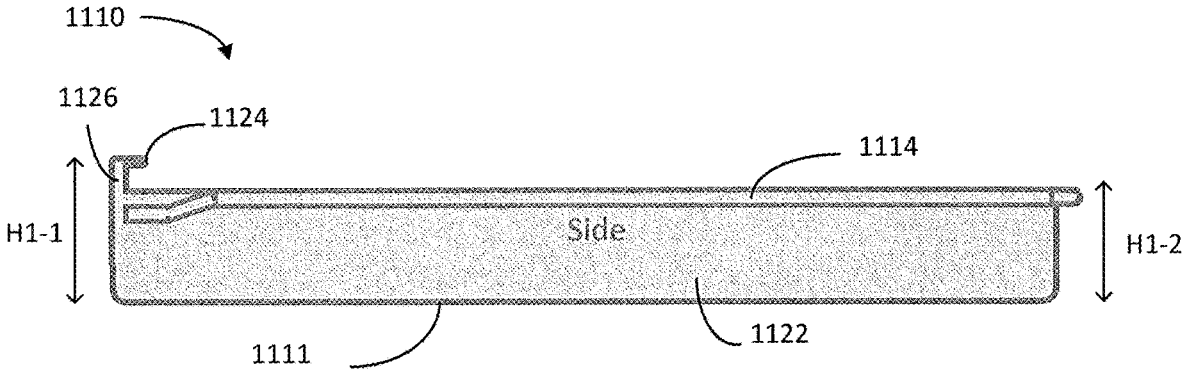
FIG. 11B is a side view of a drawer that may be used in the defrosting system of FIG. 2 in accordance with an example embodiment.
Figure 11C:
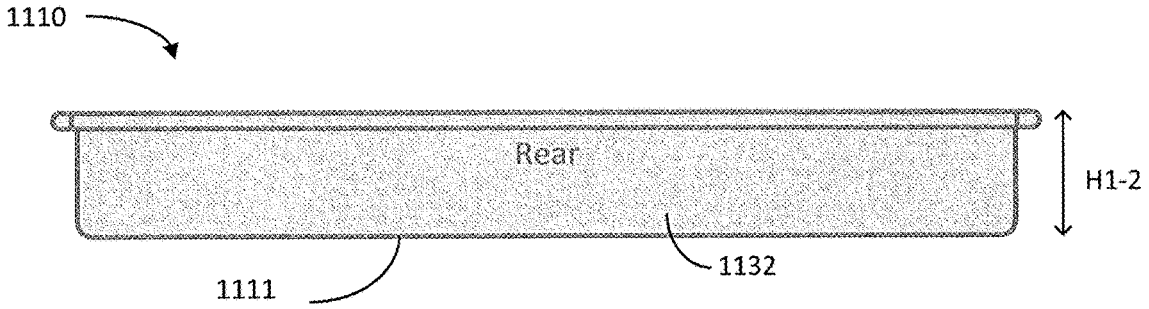
FIG. 11C is a rear view of a drawer that may be used in the defrosting system of FIG. 2 in accordance with an example embodiment.

FIGS. 11A-11C show respective front, side, and rear views of an exemplary drawer (e.g., drawer 218, 228, 321, 721, 1802, FIGS. 2, 3, 7, 18) that may be used as a containment structure in a defrosting system such as defrosting systems 210 and 220 shown in FIG. 2. Drawer 1110 may be formed entirely from conductive material, such as metal, or may be formed from a combination of conductive material(s) and dielectric material(s). In some embodiments, the drawer 1110 may be formed primarily of dielectric material (e.g., plastic) with conductive portions (e.g., metal) formed on (e.g., via plating) or integrated into the dielectric material. In some embodiments, a non-conductive coating may be formed over parts of the drawer 1110 (e.g., by dipping a stamped metal drawer in plastic or some other dielectric material while leaving the rails exposed). Conductive portions of drawer 1110 may act as an electrode in the defrosting system, similar to electrode 772 shown in FIG. 7. Drawer 1110 may also form all or part of an enclosed resonance cavity when placed (e.g., slid) under a fixed shelf (e.g., shelf 216, 226 shown in FIG. 2) of the defrosting system. The shelf may include another electrode that, when supplied with an RF signal, responsively radiates electromagnetic energy (e.g., between the shelf electrode and the conductive portions of drawer 1110). This electromagnetic energy heats a load that is being defrosted by the defrosting system.

Drawer 1110 includes a bottom wall 1111 (e.g., a "platform"), a front wall 1112, side rails 1114 and 1116, an extended front portion 1126, an overhanging lip 1124, side walls 1122, and a rear wall 1132. Side rails 1114 and 1116 may be permanently coupled to drawer 1110. In some embodiments, both of side rails 1114 and 1116 may be conductive, while in other embodiments, only one of side rails 1114 and 1116 may be conductive. Front wall 1112, including extended front portion 1126, has a height H1-1, while side walls 1122 and rear wall 1132 each have a height H1-2 that is smaller than the height H1-1. The heights of the walls essentially define the depth of an interior compartment within which a load may be placed. Alternatively, heights H1-1 and H1-2 may be substantially equal, or height H1-1 may be smaller than height H1-2. Side rails 1114 and 116 extend from side walls 1122. Side rails 1114 and 1116, for example, may slide into conductive (e.g., metal) channels of a shelf or within walls of a freezer, refrigerator, or other compartment (e.g., compartment 212, 222, 312, FIGS. 2, 3) when drawer 1110 is inserted into (e.g., physically engaged with) the defrosting system (e.g., inserted under the shelf, into channels of the shelf, onto rails of the shelf, or otherwise physically engaged with the shelf.). Alternatively, side rails 1114 and 1116 may be pushed into contact with metal terminals of the shelf when drawer 1110 is engaged to form an enclosed cavity with the shelf. Alternatively, an inverse configuration may be implemented in which, for example, side rails 1114 and 1116 may include respective channels and the shelf includes rails that slide into these channels when drawer 1110 is inserted beneath the shelf.

In some embodiments, rear wall 1132 may include a male or female plug that may electrically couple to a corresponding male or female plug of the defrosting system (e.g., disposed on a back interior wall of the defrosting system) when drawer 1110 is fully inserted under the fixed shelf. When the plug of drawer 1110 is electrically coupled to the plug of the defrosting system, some or all of drawer 1110 may be electrically coupled to a ground reference terminal (e.g., the grounded containment structure 312, 750, FIGS. 3, 7) or to a RF signal source (e.g., RF signal source 340, FIG. 3).

Figure 12A:
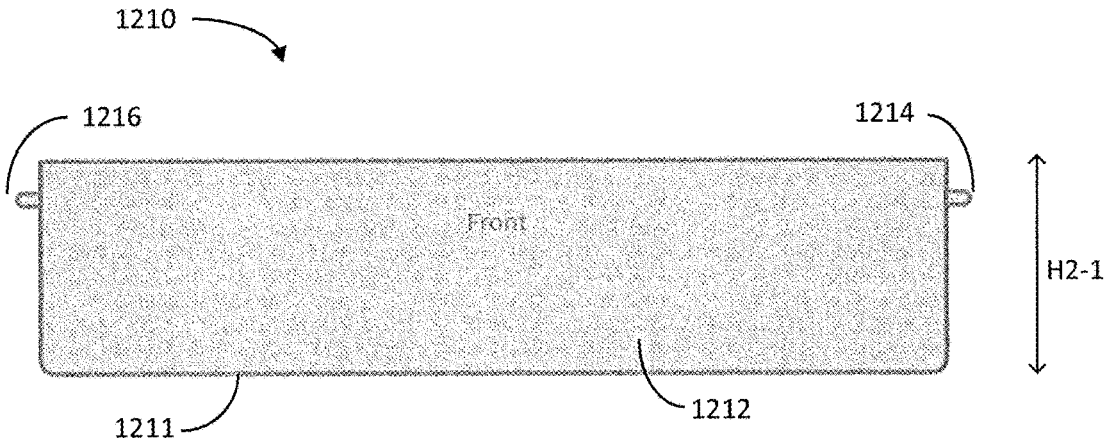
FIG. 12A is a front view of a drawer that may be used in the defrosting system of FIG. 2 in accordance with an example embodiment.
Figure 12B:
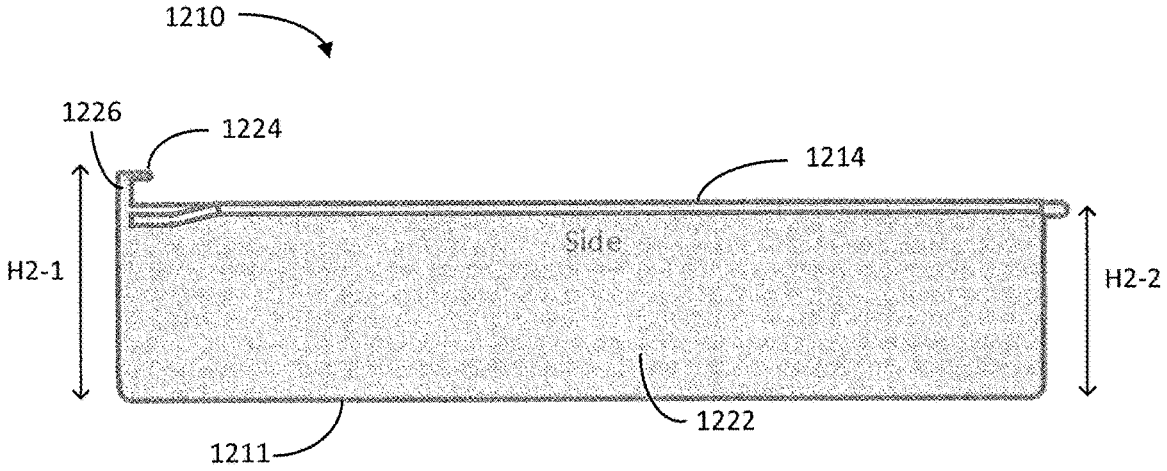
FIG. 12B is a side view of a drawer that may be used in the defrosting system of FIG. 2 in accordance with an example embodiment.
Figure 12C:
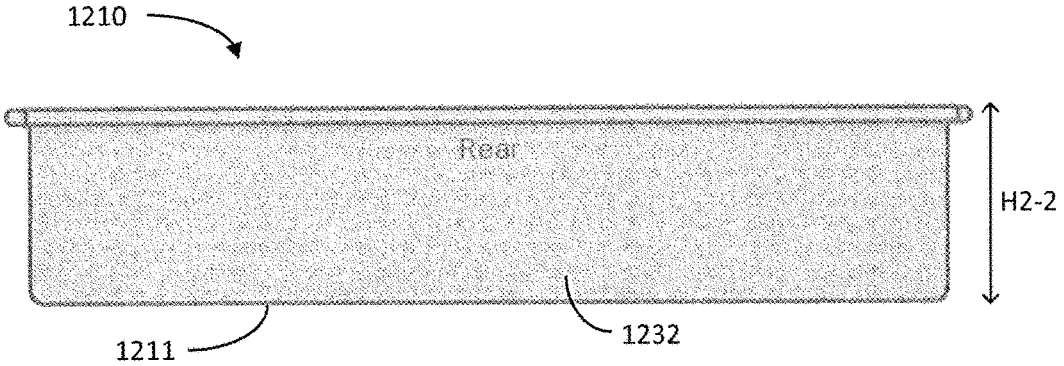
FIG. 12C is a rear view of a drawer that may be used in the defrosting system of FIG. 2 in accordance with an example embodiment.

FIGS. 12A-12C show front, side, and rear views of a drawer 1210 (e.g., drawer 218, 228, 321, 721, 1802, FIGS. 2, 3, 7, 18) having a greater height (and thus a deeper and larger interior compartment) than the drawer 1110 shown in FIGS. 11A-11C, which may be used as a containment structure in a defrosting system such as defrosting systems 210 and 220 shown in FIG. 2. Similar to drawer 1110, drawer 1210 includes a bottom wall 1211 (e.g., a "platform"), a front wall 1212, side rails 1214 and 1216, an extended front portion 1226, an overhanging lip 1224, side walls 1222, and a rear wall 1232. Some of the features of drawer 1210 may be similar to those of drawer 1110, and are not repeated here for the sake of brevity.

Front wall 1212, including extended front portion 1226, has a height H2-1, while side walls 1222 and rear wall 1232 each have a height H2-2 that is smaller than the height H2-1. Height H2-1 is larger than height H1-1 and H2-2 is larger than height H1-2. Accordingly, the interior compartment of drawer 1210 is deeper than the interior compartment of drawer 1110. However, the relative dimensions and placements of features of drawers 1110, 1210 that slide into conductive (e.g., metal) channels of a shelf or within walls of a freezer, refrigerator, or other compartment (e.g., compartment 212, 222) when drawers 1110, 1210 are inserted into a defrosting system (e.g., inserted under the shelf, into channels of the shelf, onto rails of the shelf, or otherwise physically engaged with the shelf) are the same for both drawers 1110, 1210. The difference between drawers 1110 and 1210 illustrates that drawers having different heights (i.e., drawers having interior compartments with different depths or sizes) may be used in the same defrosting system. In other words, drawers 1110 and 1210 may form two components of a kit of multiple drawers that are compatible for use in the same defrosting system. Due to the difference in height between drawers 1110 and 1210, it may be advantageous to use drawer 1110 for defrosting smaller (shorter) loads, while it may be advantageous to use drawer 1210 for defrosting comparatively larger (taller) loads. For example, a smaller load may fit into both drawers 1110 and 1210, but it may be more power efficient to defrost the smaller load in drawer 1110, as drawer 1110 creates a smaller resonance cavity compared to the resonance cavity created by drawer 1210 (e.g., due to differences in drawer height or interior compartment depth). As another example, a larger load may fit into drawer 1210, but may be too large or tall to fit into drawer 1110 without impeding the ability of drawer 1110 to close (e.g., to slide beneath the shelf). Thus, having two or more drawers of different sizes that are capable of being used in a single defrosting system may be advantageous as it allows a consumer to select a drawer that will create an appropriately sized resonance cavity for a load having a given shape and size.

Figure 13A:
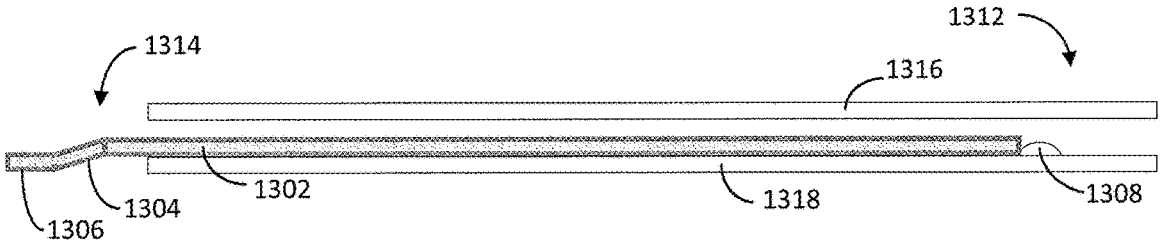
FIG. 13A is a side view of a contact mechanism for a defrosting system in which a side rail of a drawer in a disengaged position in a conductive channel in accordance with an example embodiment.
Figure 13B:
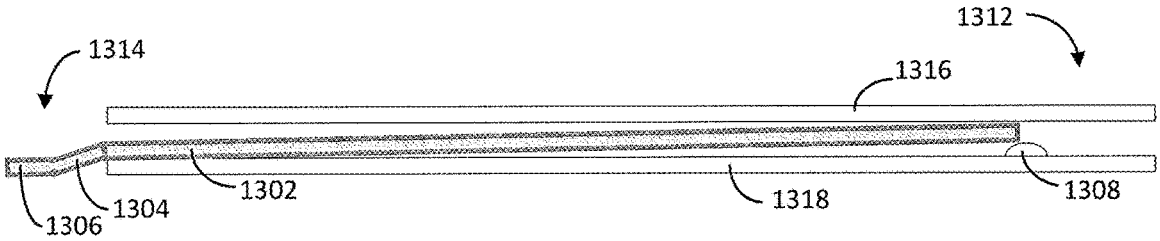
FIG. 13B is a side view of a contact mechanism for a defrosting system in which a side rail of a drawer in a partially engaged position in a conductive channel in accordance with an example embodiment.
Figure 13C:
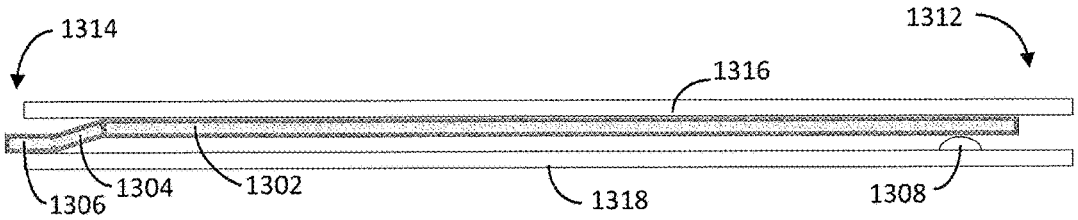
FIG. 13C is a contact mechanism for a defrosting system in which a side view of a side rail of a drawer in an engaged position in a conductive channel in accordance with an example embodiment.

In order for conductive portions of the drawers 1110 and 1210 to be securely grounded, one or more contact mechanisms may be implemented. The contact mechanisms essentially may function as a safety interlock, in that the system may be disabled from performing defrosting or heating operations when the contact mechanisms are not engaged (e.g., as illustrated in FIGS. 13A and 13B, below), and the system may be enabled from performing defrosting or heating operations when the contact mechanisms are engaged (e.g., as illustrated in FIG. 13C, below). More specifically, FIGS. 13A-13C show side views of various positions of a mechanism for ensuring secure contact between a side rail of a drawer (e.g., side rail 1114 of drawer 1110 or side rail 1214 of drawer 1210) and a partially conductive channel of a shelf (e.g., shelf 216 shown in FIG. 2) or of a wall of a freezer, refrigerator, or other compartment. Essentially, the partially conductive channel is shaped so that the side rail may slidably engage with the channel, and a bottom interior surface of the channel may support a bottom surface of the side rail (and thus the channel may support the drawer).

FIG. 13A shows a side view of a disengaged position of a contact mechanism in which side rail 1314 (e.g., side rail 1114 of drawer 1110 or side rail 1214 of drawer 1210, FIGS. 11, 12) is partially inserted into a partially conductive (e.g., metal) channel 1312 (e.g., which in some embodiments may be referred to as a second conductive feature) of a shelf or compartment wall, but has not been inserted far enough to contact nub 1308. In some embodiments, side rail 1314 may include a conductive coating (e.g., which in some embodiments may be referred to as a first conductive feature) that is integrally formed with side rail 1314 and which may be permanently electrically coupled to an electrode of a drawer to which side rail 1314 is permanently connected, for example, by conductive traces formed on dielectric material of the drawer). Channel 1312 may include a top interior wall 1316 and a bottom interior wall 1318. Side rail 1314 may include multiple portions 1302, 1304, and 1306. Portion 1302 may be significantly longer than portions 1304 and 1306. Portion 1306 may extend along an axis (e.g., a second axis) that is parallel to and offset from an axis (e.g., a first axis) along which portion 1302 extends. Portion 1304 may connect an end of portion 1302 to an end of portion 1306 and may be extend along an axis that intersects the axes along which portions 1302 and 1306 extend (e.g., diagonally). Nub 1308 may be a bump or rub button disposed on a bottom interior surface in conductive channel 1312. Nub 1308 may have a substantially smooth surface and may be formed from a material with a relatively low coefficient of friction, such as polytetrafluoroethylene (PTFE) or nylon so as to allow portion 1302 of side rail 1314 to slide along its surface. In this position, the drawer is partially open and is disabled from performing defrosting operations.

FIG. 13B shows a side view of a partially engaged position of the contact mechanism in which side rail 1314 is partially inserted into conductive channel 1312, and is in contact with nub 1308. Portions 1304 and 1306 of side rail 1314 are still outside of conductive channel 1312, but the distal end of portion 1302 has been raised after sliding along nub 1308 such that this distal end is in contact with both nub 1308 and the top interior wall 1316 of conductive channel 1312. In this position, the drawer is still partially open and remains disabled from performing defrosting operations.

FIG. 13C shows a side view of a fully engaged position of the contact mechanism in which side rail 1314 is fully inserted into conductive channel 1312 (e.g., such that a removable drawer or platform to which the side rail 1314 is permanently attached is fully physically engaged with a shelf that includes the conductive channel 1312), such that the distal end of portion 1302 of side rail 1314 is in contact with nub 1308 and the top interior wall 1316, such that portion 1306 of side rail 1314 is in contact with bottom interior wall 1318 (e.g., an additional portion of the bottom interior surface of wall 1318 that is different from the portion on which nub 1308 is formed), and such that conductive channel 1312 is physically and electrically connected to side rail 1314. All of portions 1302, 1304, and 1306 of side rail 1314 are located inside conductive channel 1312, and the top of portion 1302 is effectively pushed into and held in secure electrical contact with the top interior wall 1316 (e.g., the top interior surface of wall 1316) of conductive channel 1312 by portions 1304 and 1306 and by nub 1308. In this position, the drawer is closed to create an enclosed cavity and defrosting operations are enabled and may be performed. In some embodiments side rail 1314 may be electrically connected to a ground voltage reference through its connection with conductive channel 1312, while in other alternative embodiments, the conductive channel 1312 may be electrically connected to the ground voltage reference through the side rail 1314.

In some embodiments, rather than including the nub 1308, conductive channel 1312 may be lined with conductive spring-like material (e.g., finger stock gaskets) on the top interior wall 1316 and/or the bottom interior wall 1318. These linings may provide electrical coupling between the conductive channel 1312 and the side rail 1314 when the side rail 1314 is fully inserted in the conductive channel 1312, and may help hold the side rail 1314 in place. Alternatively, a mechanical clamp may be used to hold the side rail 1314 in contact with the conductive channel 1312.

Figure 14A:
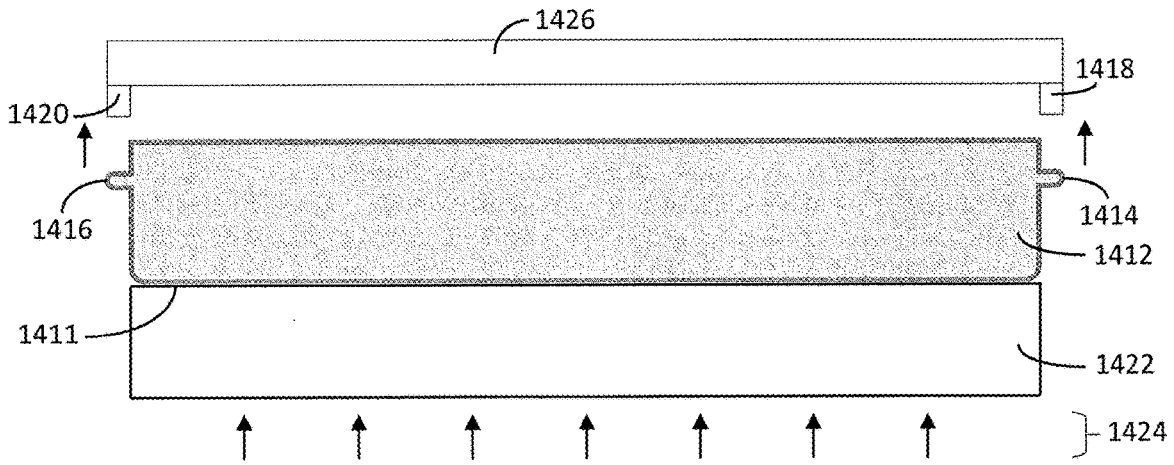
FIG. 14A is a front view of a contact mechanism for a defrosting system in which a drawer is in a disengaged position in accordance with an example embodiment.
Figure 14B:
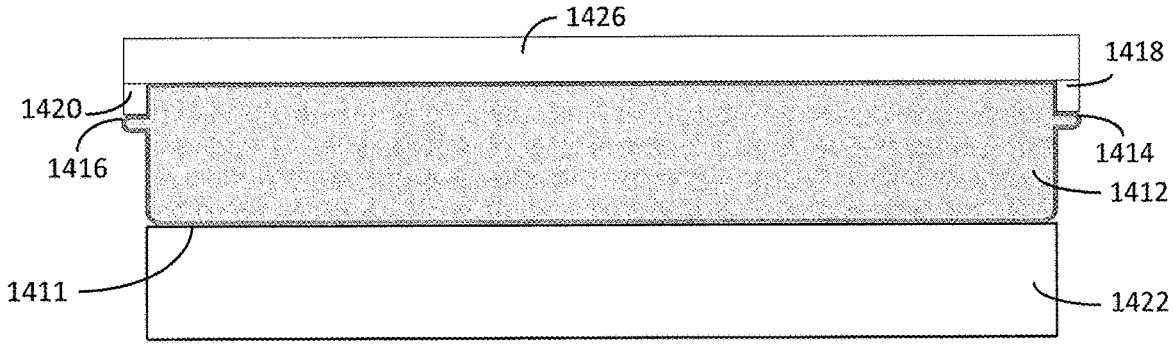
FIG. 14B is a front view of a contact mechanism for a defrosting system in which a drawer is in an engaged position after being pushed into contact with conductive terminals in accordance with an example embodiment.

FIGS. 14A and 14B show a front view of an alternative contact mechanism for securing electrical contact (e.g., grounding) between a shelf (e.g., shelf 216, 226 shown in FIG. 2) and a drawer (e.g., drawer 218, 228, 321, 721, 1110, 1210, FIGS. 2, 3, 7, 11, 12) in a defrosting system (e.g., defrosting systems 210 and 220 shown in FIG. 2). Drawer 1412 may be placed on a block 1422 or other type of support structure beneath fixed shelf 1426. Shelf 1426 may include conductive terminals 1418 and 1420 that may be, for example, electrically connected to a ground or common voltage potential. Alternatively, the conductive terminals 1418 and 1420 may be connected to a wall of the freezer, refrigerator, or other compartment. Block 1422 may have a top surface that contacts a bottom surface (e.g., an exterior bottom surface) of a bottom wall 1411 (e.g., a platform) of drawer 1412, and may have a bottom surface that is connected to a lift mechanism (not shown), such as a scissor lift. The lift mechanism may be operated manually or may be electrically powered.

FIG. 14A shows the contact mechanism in a disengaged state in which side rails 1414 and 1416 of drawer 1412 are not in electrical contact with conductive terminals 1418 and 1420. In this position, drawer 1412 is considered open (i.e., the safety interlock is disengaged) and the system is disabled from performing defrosting operations. Through operation of the lift mechanism, block 1422 may push (e.g., apply pressure to) drawer 1412 in the direction of arrows 1424. FIG. 14B shows the contact mechanism in an engaged state in which block 1422 has pushed drawer 1412 so that side rails 1414 and 1416 (and/or conductive sidewalls of the drawer 1412) are in electrical contact with conductive terminals 1418 and 1420. Block 1422 may maintain pressure on the bottom surface of drawer 1412 in order to ensure that side rails 1414 and 1416 remain in electrical contact with conductive terminals 1418 and 1420 of shelf 1426. The connection between side rails 1414, 1416 and conductive terminals 1418, 1420 may serve to provide electrical grounding for the conductive portions of drawer 1412 that act as an electrode for the defrosting system. In this position, drawer 1412 is considered closed and the system is enabled to perform defrosting operations.

FIG. 15 shows a top down view of an interior bottom wall 1500 (e.g., interior bottom surface or "platform") of a drawer (e.g., drawers, 218, 228, 321, 721, 1110, 1210, FIGS. 2, 3, 7 11, 12) and illustrates an embodiment in which only a portion of the drawer is formed from conductive material. Wall 1500 includes electrode 1504 (e.g., electrode 772, FIG. 7) and conductive paths 1506 and 1508 that are formed from conductive material such as metal (e.g., copper, tungsten, gold, or any combination of these), and are electrically coupled to electrode 1504. Wall 1500 further includes dielectric material 1502 that may be formed, for example, from plastic or glass. Electrode 1504 and conductive paths 1506 and 1508 may be deposited on dielectric material 1502, and in some instances may be embedded in dielectric material 1502 such that the upper surfaces of electrode 1504 and conductive paths 1506 and 1508 are substantially planar with the upper surface of dielectric material 1502. Conductive paths 1506 and 1508 may electrically connect electrode 1504 to the conductive side rails of the drawer. For example, conductive paths 1506 may be in electrical contact with conductive metallization (not shown) in or on sidewalls of the drawer (e.g., any one or more of walls 1112, 1122, 1132, 1212, 1222, 1232, FIGS. 11, 12), where the conductive metallization is also in conductive contact with the conductive side rails of the drawer. In this way, the electrode may be electrically coupled to a voltage potential (e.g., a ground voltage potential) supplied through the conductive portions of the channel of the shelf (or compartment wall) of the defrosting system. While electrode 1504 is shown to be circular, it should be understood that this is illustrative and that electrode 1504 may take any desired shape including, square, rectangular, pyramidal, etc. As shown, electrode 1504 has a diameter D1. Electrode 1504 has an area that is significantly smaller than the area of the bottom interior surface of the drawer. In alternate embodiments, an electrode 1504 may have an area that is substantially equal to the area of the bottom interior surface of the drawer.

An identifier 1510 may be included in the wall 1500. Identifier 1510 may be one of a variety of types of identifier, including but not limited to: an RF identification (RFID) tag, a shape or pattern that is detectable with an optical recognition system, or any other desired type of identifier. Identifier 1510 may indicate one or more features of electrode 1504 and/or the drawer of which wall 1500 may be a part, such as the size and shape of electrode 1504 and/or the size and shape of the drawer when processed by recognition circuitry coupled to the shelf under which the drawer is disposed, which is described in greater detail in connection with FIG. 17 below.

FIG. 16 shows a top down view of an interior bottom wall (e.g., interior bottom surface or "platform") of a drawer (e.g., drawers 218, 220, 321, 721, 1110, 1210, FIGS. 2, 3, 7, 11, 12) and illustrates an embodiment in which only a portion of the drawer is formed from conductive material. Wall 1600 includes electrode 1604 (e.g., electrode 772, FIG. 7) and conductive paths 1606 and 1608 that are formed from conductive material such as metal (e.g., copper, tungsten, gold, or any combination of these), and are electrically coupled to electrode 1604. Wall 1600 further includes dielectric material 1602 that may be formed, for example, from plastic or glass. Electrode 1604 and conductive paths 1606 and 1608 may be deposited on dielectric material 1602, and in some instances may be embedded in dielectric material 1602 such that the upper surfaces of electrode 1604 and conductive paths 1606 and 1608 are substantially planar with the upper surface of dielectric material 1602. Conductive paths 1606 and 1608 may electrically connect electrode 1604 to the side rails of the drawer. For example, conductive paths 1606 may be in electrical contact with conductive metallization (not shown) in or on sidewalls of the drawer (e.g., any one or more of walls 1112, 1122, 1132, 1212, 1222, 1232, FIGS. 11, 12), where the conductive metallization is also in conductive contact with the conductive side rails of the drawer. In this way, the electrode may be electrically coupled to a voltage potential (e.g., a ground voltage potential) supplied through the conductive portions of the channel of the shelf (or compartment wall) of the defrosting system. While electrode 1604 is shown to be circular, it should be understood that this is illustrative and that electrode 1604 may take any desired shape including, square, rectangular, etc. As shown, electrode 1604 has a diameter D2.

As shown in FIGS. 15 and 16, walls 1500 and 1600 may each have electrodes of different diameters or areas. Electrode 1504 of FIG. 1500 has a diameter D1 that is larger than diameter D2 of electrode 1604 of FIG. 1600, and thus electrode 1504 has an area that is significantly larger than the area of electrode 1604. By providing, in a kit associated with defrosting/heating system, multiple drawers each having different electrode sizes, a consumer is able to select a drawer for use in the defrosting system having an electrode that best suits the size and shape of the load being defrosted. For example, a smaller load may fit within the circumference of both electrodes 1504 and 1604, but power may be conserved by using the smaller electrode 1604 to heat the smaller load, as heating the smaller load with the larger electrode 1504 may result in a portion of the RF energy generated during the defrosting operations to be wasted (e.g., to not contribute to the heating of the smaller load). Conversely, a larger load may fit within the circumference of electrode 1504, but not within the circumference of electrode 1604. Attempting to heat this larger load with electrode 1604 may result in a portion of the larger load not being successfully defrosted or heated by defrosting/heating operations performed by the defrosting system, as these portions of the larger load may not overlap with electrode 1604 and would therefore receive little or no RF energy (e.g., heating energy) compared to the portions of the larger load that do overlap electrode 1604. Thus, it may be advantageous for defrosting systems to include and to be compatible with multiple drawers having electrodes of varying sizes and shapes so that a wider range of loads with different shapes and sizes may be defrosted. Identifier 1610 of FIG. 16 may be different from identifier 1510 of FIG. 15 so that each of the different sized electrodes 1604 and 1504 may be uniquely identified when its respective drawer is inserted under/into the shelf (e.g., by recognition circuitry coupled to the shelf).

Figure 17:
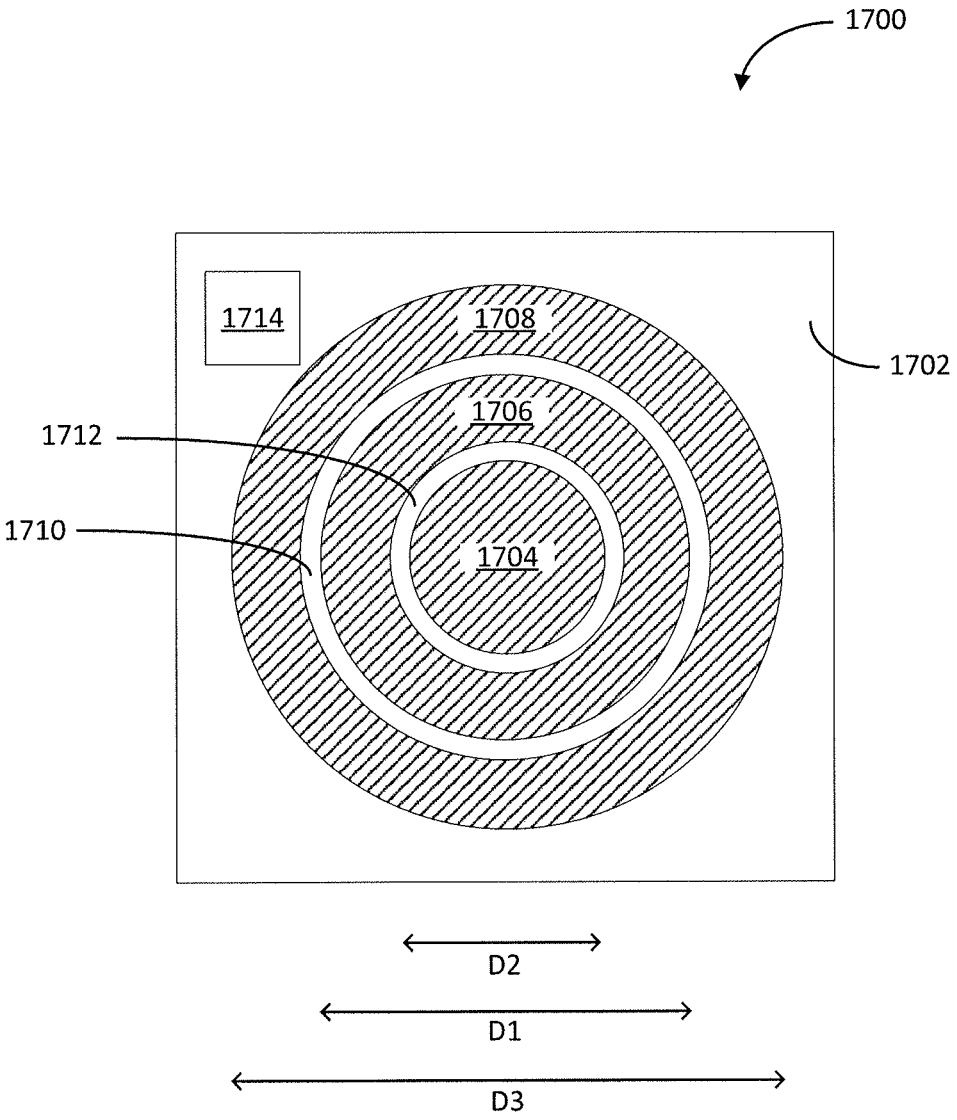
FIG. 17 is a bottom view of an interior top surface of a defrosting system, where the interior top surface may include individually selectable electrodes of varying size and shape, and where the interior top surface may face an interior bottom wall of a drawer of the type shown in FIG. 15 or FIG. 16, in accordance with an example embodiment.

While the electrode-containing drawers of the defrosting system may be easily swapped in and out according to the electrode-size needs of a consumer, the electrode contained within the static shelf may not be as simple to swap out. FIG. 17 shows an interior top view of a shelf (e.g., shelf 216 or 226 shown in FIG. 2) having multiple selectable electrodes for use, for example, in conjunction with electrodes 1504 and 1604 shown in FIGS. 15 and 16. Shelf 1700 includes electrodes 1704, 1706, and 1708 (e.g., electrode 370, 770, 1812, FIGS. 3, 7, 18) that are formed from conductive material such as metal (e.g., copper, tungsten, gold, or any combination of these). Electrodes 1704, 1706, and 1708 may be arranged opposite to and facing an electrode of a drawer (e.g., drawer 218, 228, 321, 721, 1110, 1210, FIGS. 2, 3, 7, 11, 12) disposed below shelf 1700, and across the cavity (e.g., cavity 310, 1806, FIGS. 3, 18) within which a load may be placed. Shelf 1700 further includes dielectric material 1702 that includes portion 1710 disposed between electrodes 1708 and 1706 and portion 1712 disposed between electrodes 1706 and 1704. Dielectric material 1702 may be formed, for example, from plastic or glass. Electrodes 1704, 1706, and 1708 may be deposited on dielectric material 1702, and in some instances may be embedded in dielectric material 1702 such that the upper surfaces of electrodes 1704, 1706, and 1708 are substantially planar with the upper surface of dielectric material 1702. Portions 1710 and 1712 of dielectric material 1702 may serve to electrically isolate electrodes 1704, 1706, and/or 1708 from one another when one or more of these electrodes are not selected for use. Shelf 1700 may include or may be coupled to switching circuitry (not shown) that may select one or a combination of electrodes 1704, 1706, and 1708 to receive an RF signal (e.g., from RF signal source 340, FIG. 3) and responsively radiate electromagnetic energy during defrosting operations. The electrodes may be selected for use based on at least the size and shape of the electrode of the drawer disposed under shelf 1700. For example, when it is detected that the inserted drawer includes electrode 1504 shown in FIG. 15 as having diameter D1, electrodes 1704 and 1706 may each be selected for an effective electrode diameter of D1 to match the diameter of electrode 1504. As another example, when it is detected that the inserted drawer includes electrode 1604 shown in FIG. 16 as having a diameter D2, only electrode 1704 may be selected for an effective electrode diameter of D2 to match the diameter of the electrode 1604. Electrode 1708 having diameter D3, which is larger than diameters D1 and D2, may not be selected unless a drawer electrode is detected having a diameter greater than or equal to D3.

Shelf 1700 may include recognition circuitry 1714 for determining the type of drawer inserted under/into shelf 1700 based on the identifier (e.g., identifier 1510 shown in FIG. 15 or identifier 1610 shown in FIG. 16) that is present on that drawer. For example, recognition circuitry 1714 may include an RFID scanner or optical shape or pattern recognition circuitry such as an optical camera. The recognition circuitry 1714 in the shelf may process the identifier to generate corresponding identifier data. This identifier data may be compared (e.g., by system controller 330, FIG. 3) to values stored in memory (e.g., as part of a look-up-table (LUT)) to determine the type of drawer that has been inserted, which in turn may determine the size and shape of an electrode (e.g., corresponding to the size and shape of electrode 1504 shown in FIG. 15 or electrode 1604 shown in FIG. 16) predetermined to be associated with that particular identifier, and/or may determine a combination of electrodes 1704, 1706, 1708 that should be selected. The combination of electrodes 1704, 1706, and 1708 may be selected to receive an RF signal during defrosting operations performed by the defrosting system. The combination of electrodes that receive the input RF signal (e.g., the electrodes that are energized by the RF signal) are selected based on one or more features of the electrode and/or the drawer inserted under/into shelf 1700, such as the size and shape of the electrode of the drawer inserted under/into shelf 1700 as determined by recognition circuitry 1714. The type of drawer that has been inserted may also be displayed on a screen of a user interface (e.g., the user interface 320, FIG. 3).

It should be noted that the identification circuitry and recognition circuitry described above in connection with drawer recognition functions are illustrative. If desired, other means of drawer identification may instead be implemented.

By switchably selecting which electrodes in shelf 1700 are active during defrosting operations, the defrosting system can accommodate a variety of drawer electrode sizes without having to physically replace the electrode in shelf 1700. It should be noted that while only three electrodes 1704, 1706, 1708 are shown here, this is not meant to be limiting and any number of selectable electrodes of varying diameters, dimensions, shapes, and relative positions may be included in the shelf of a defrosting system in a concentric circle arrangement, as shown, or in other arrangements.

Figure 18:
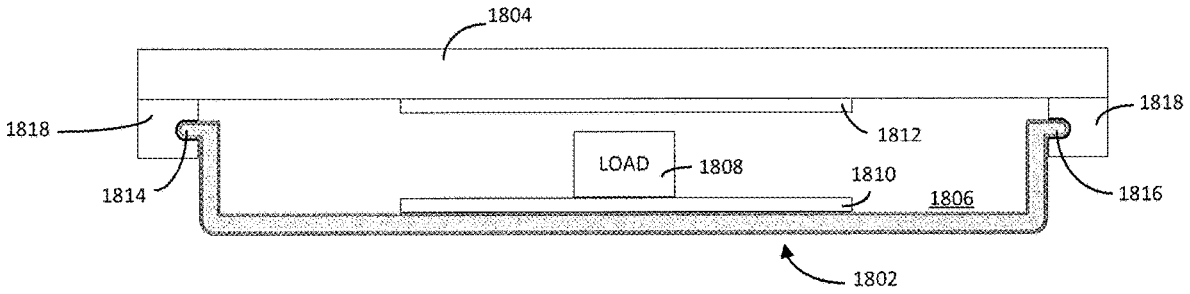
FIG. 18 is a cross-sectional front view of an illustrative defrosting system showing a drawer inserted under a shelf to create a cavity in which a load is disposed, in accordance with an example embodiment.

FIG. 18 shows a cross-sectional front view of a defrosting system (e.g., defrosting systems 210 and 220 shown in FIG. 2) having a drawer (e.g., drawers 218, 228, 321, 721, 1110, 1210, 1412, FIGS. 2, 3, 7, 11, 12, 14) inserted under/into a shelf (e.g., shelf 216, 226, FIG. 2) to create a cavity in which a load (e.g., load 316 shown in FIG. 3) is disposed. As shown, drawer 1802 may be placed (e.g., slid or inserted or otherwise physically engaged) beneath/into shelf 1804. Drawer 1802 may be removable, but may, along with shelf 1804, form an enclosed cavity 1806 when fully inserted beneath/into shelf 1804 as shown. Drawer 1802 may include sidewalls (e.g., sidewalls 1122, 1222, FIGS. 11, 12) with conductive side rails 1814 and 1816 (e.g., side rails 1114, 1116, 1214, 1216, 1414, 1416, FIGS. 11, 12, 14) that are inserted into at least partially conductive channels 1818 (e.g., channel 1312, FIG. 13) of shelf 1804 (or channels formed in the walls of the freezer, refrigerator, or other compartment) such that there is electrical contact between side rails 1814 and 1816 and the at least partially conductive channels 1818. This electrical contact may enable a voltage reference signal (e.g., a ground or common voltage reference signal) to be applied from a voltage reference source (not shown) in shelf 1804 (or the freezer, refrigerator, or other compartment) to side rails 1814 and 1816 through the at least partially conductive channels 1818. As discussed above, in an alternate embodiment, the drawer may include one or more channels, and the shelf (or compartment walls) may include one or more corresponding conductive rails.

In some instances, drawer 1802 may be formed entirely from conductive material. In other instances, drawer 1802 may be formed from both conductive material and dielectric material, and the conductive material of drawer 1802 may form an electrode similar to electrodes 1504 and 1604 shown in FIGS. 15 and 16. Such an electrode may be formed overlapping non-conductive barrier 1810. Load 1808 is a load that is disposed in cavity 1806 for defrosting. Load 1808 may, for example, be a food load or any other load desired to be defrosted, thawed, or heated. Shelf 1804 includes one or more electrodes 1812 which may be arranged and configured similarly to electrodes 1704, 1706, and 1708 shown in FIG. 17.

In embodiments in which drawer 1802 includes an electrode formed in or on dielectric material, the drawer electrode may be formed facing and opposite to electrode(s) 1812 of shelf 1804, when the drawer 1802 is fully installed in the system. The drawer electrode may also receive the voltage reference signal (or ground signal) applied at side rails 1814 through conductive traces formed on or below the interior walls of drawer 1802.

It should be understood that the order of operations associated with the methods described herein and depicted in the figures correspond to example embodiments, and should not be construed to limit the sequence of operations only to the illustrated orders. Instead, some operations may be performed in different orders, and/or some operations may be performed in parallel.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

In accordance with an embodiment, a system may include a radio frequency (RF) signal source that may produce an RF signal, a first structure that includes a first electrode, a second structure, and a second conductive feature. The second conductive structure may include a second electrode that at least partially vertically overlaps the first electrode when the second structure is physically engaged with the first structure, and a first conductive structure that is permanently coupled to the second structure. The first structure may be electrically coupled to the RF signal source. The first structure and the second structure may be physically engaged together in a non-permanent manner to create a cavity between the first structure and the second structure. The second conductive feature may physically and electrically connect to the first conductive feature when the second structure is fully physically engaged with the first structure.

In accordance with another aspect of the embodiment, the first structure may include a shelf. The second structure may include a removable platform that forms a portion of a removable drawer. The first conductive feature may be permanently electrically coupled to the second electrode.

In accordance with another aspect of the embodiment, the removable drawer may be formed entirely from conductive material.

In accordance with another aspect of the embodiment, the removable drawer may include a side rail to which the first conductive feature is connected, dielectric material on which or in which the second electrode is formed, and one or more conductive traces formed in or on the dielectric material that electrically connect the second electrode to the first conductive feature. The first conductive feature may be integrally formed with the side rail.

In accordance with another aspect of the embodiment, the system may include a voltage reference that is electrically coupled to the second conductive feature, and a channel into which the side rail is insertable. The first and second conductive features may connect when the side rail is fully inserted into the channel to provide an electrical path between the second electrode and the voltage reference.

In accordance with another aspect of the embodiment, the second conductive feature may be positioned at a top interior surface of the channel. The channel may include a nub formed on a portion of a bottom interior surface of the channel. The first conductive feature of the side rail may be held in electrical contact with the second conductive feature at the top interior surface of the channel by the nub when the side rail is fully inserted into the channel. The nub may be formed from nylon or polytetrafluoroethylene.

In accordance with another aspect of the embodiment, the side rail may include a first portion that a first portion, a second portion, and a third portion. The first portion may extends along a first axis and may include a distal portion that is in contact with the nub and the top interior surface of the channel when the side rail is fully inserted into the channel. The second portion may extend along a second axis parallel to the first axis and may be in contact with an additional portion the bottom interior surface of the channel that is different from the portion of the bottom interior surface of the channel on which the nub is formed when the side rail is fully inserted into the channel. The third portion may extends along a third axis that intersects the first and second axes and may connect the first portion to the second portion.

In accordance with another aspect of the embodiment, the system may include an identifier coupled to the removable platform that identifies one or more features of the second electrode. The shelf may include a third electrode adjacent to the first electrode, a fourth electrode adjacent to the third electrode and the first electrode, and recognition circuitry that determines the one or more features of the second electrode based on the identifier. The shelf may selectively apply the RF signal to one or more of the first electrode, the third electrode, and the fourth electrode based on the identified one or more features of the second electrode.

In accordance with an embodiment, a system may include a RF signal source that produces an RF signal, a shelf that includes a first electrode, a transmission path between the RF signal source and the first electrode that is positioned proximate to a cavity of the system, and a removable platform that is disposed beneath the shelf and that includes a second electrode that is arranged opposite to and facing the first electrode. The transmission path may convey the RF signal from the RF signal source to the first electrode.

In accordance with another aspect of the embodiment, the removable platform may form part of a removable drawer that includes a conductive side rail permanently connected to a side of the removable drawer, dielectric material on which the second electrode is disposed, and one or more conductive traces disposed on the dielectric material that electrically connect the second electrode to the conductive side rails.

In accordance with another aspect of the embodiment, the system may include a support structure that is in contact with the removable platform and that may push the removable drawer into contact with the shelf.

In accordance with another aspect of the embodiment, the shelf may further include a voltage reference and conductive terminals that are in electrical contact with the conductive side rails and the voltage reference. The conductive terminals may electrically couple the conductive side rails to the voltage reference. The support structure may apply pressure to the removable platform of the removable drawer to maintain electrical contact between the conductive terminals and the conductive side rails.

In accordance with another aspect of the embodiment, the drawer may include an identifier disposed on the removable platform that identifies one or more features of the second electrode. The shelf may include a third electrode adjacent to the first electrode, a fourth electrode adjacent to the third electrode and the first electrode, and recognition circuitry that may determine the one or more features of the second electrode based on the identifier. The shelf may selectively apply the RF signal to the first electrode, the third electrode, and/or the fourth electrode based on the identified one or more features of the second electrode.

In accordance with an embodiment, a drawer that is able to be inserted beneath a shelf to form a cavity may include an electrode formed on a platform of the drawer, and a conductive side rail that is electrically coupled to the electrode. The electrode may overlap a second electrode of the shelf when the drawer is inserted beneath the shelf. The conductive side rail may be inserted into a metal channel of the shelf.

In accordance with another aspect of the embodiment, the drawer may include an identifier formed on the platform of the drawer that identifies one or more features of the second electrode, and conductive traces formed on the dielectric interior bottom wall of the drawer and on interior sidewalls of the drawer. The conductive traces may electrically couple the conductive side rail to the electrode.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

The invention claimed is:

1. A system comprising:

a radio frequency (RF) signal source configured to produce an RF signal;

a first structure comprising a shelf and including:

a first electrode, wherein the first electrode is configured to electrically couple to the RF signal source; and a second electrode adjacent to the first electrode, wherein the second electrode is configured to electrically couple to the RF signal source;

a second structure comprising a platform that forms a portion of a removable drawer, wherein the first structure and the second structure are configured to be physically engaged together in a non-permanent manner to create a cavity between the first structure and the second structure when the second structure is inserted under the first structure, the second structure comprising:

a third electrode that at least partially vertically overlaps at least one of the first electrode and the second electrode when the second structure is physically engaged with the first structure, and a first conductive feature that is permanently coupled to the second structure, wherein the first conductive feature is permanently electrically coupled to the third electrode, wherein the platform includes an identifier coupled to the platform that identifies at least one of a size and a shape of the third electrode;

a second conductive feature that is configured to physically and electrically connect to the first conductive feature when the second structure is fully physically engaged with the first structure; and recognition circuitry configured to:

detect the identifier; and cause one of the first electrode and the second electrode to be electrically coupled to the RF signal source and the other of the first electrode and the second electrode to be disconnected from the RF signal source based on the identifier.

2. The system of claim 1, wherein the removable drawer is formed entirely from conductive material.

3. The system of claim 1, wherein the removable drawer further comprises:

a side rail to which the first conductive feature is connected;

dielectric material on which or in which the third electrode is formed; and one or more conductive traces formed in or on the dielectric material that electrically connect the third electrode to the first conductive feature.

4. The system of claim 3, wherein the first conductive feature is integrally formed with the side rail.

5. The system of claim 3, further comprising:

a voltage reference electrically coupled to the second conductive feature; and a channel into which the side rail is insertable, wherein the first and second conductive features connect when the side rail is fully inserted into the channel to provide an electrical path between the third electrode and the voltage reference.

6. The system of claim 5, wherein the second conductive feature is positioned at a top interior surface of the channel, and wherein the channel comprises:

a nub formed on a portion of a bottom interior surface of the channel, wherein the first conductive feature of the side rail is held in electrical contact with the second conductive feature at the top interior surface of the channel by the nub when the side rail is fully inserted into the channel.

7. The system of claim 6, wherein the nub is formed from a material selected from the group consisting of nylon and polytetrafluoroethylene.

8. The system of claim 6, wherein the side rail comprises:

a first portion that extends along a first axis and that includes a distal portion that is in contact with the nub and the top interior surface of the channel when the side rail is fully inserted into the channel, wherein the top interior surface of the channel is planar;

a second portion that extends along a second axis parallel to the first axis and that is in contact with an additional portion of the bottom interior surface of the channel that is different from the portion of the bottom interior surface of the channel on which the nub is formed when the side rail is fully inserted into the channel, wherein the bottom interior surface of the channel is planar; and a third portion that extends along a third axis that intersects the first and second axes and that connects the first portion to the second portion, wherein an entire top surface of the first portion is in contact with the top interior surface of the channel and the first portion is parallel to the top interior surface of the channel when the side rail is fully inserted into the channel and the distal portion of the first portion is in contact with the nub and the bottom surface of the second portion is in contact with the additional portion of the bottom interior surface.

* * * * *